US007857013B2

(12) United States Patent
Wadahara et al.

(10) Patent No.: US 7,857,013 B2
(45) Date of Patent: Dec. 28, 2010

(54) METHOD FOR PRODUCING CARBON FIBER WOVEN FABRIC

(75) Inventors: Eisuke Wadahara, Iyo-gun (JP); Ikuo Horibe, Iyo-gun (JP); Shigeru Miyamoto, Hakui (JP); Kyoko Miyamoto, legal representative, Kanazawa (JP); Kenichi Takezawa, Hakui (JP); Kuniyoshi Kurihara, Ishikawa-gun (JP); Kazuhiro Ohno, Ishikawa-gun (JP)

(73) Assignee: Toray Industries, Inc., Tokyo (JP)

( * ) Notice: Subject to any disclaimer, the term of this patent is extended or adjusted under 35 U.S.C. 154(b) by 0 days.

(21) Appl. No.: 12/298,396

(22) PCT Filed: Apr. 27, 2007

(86) PCT No.: PCT/JP2007/059145

§ 371 (c)(1), (2), (4) Date: Aug. 5, 2009

(87) PCT Pub. No.: WO2007/126040

PCT Pub. Date: Nov. 8, 2007

(65) Prior Publication Data

US 2010/0032049 A1 Feb. 11, 2010

(30) Foreign Application Priority Data

Apr. 28, 2006 (JP) ..... 2006-124868

(51) Int. Cl.
*D03D 41/00* (2006.01)
*D03D 13/00* (2006.01)
*D03D 25/00* (2006.01)

(52) U.S. Cl. ..... 139/11; 139/383 R; 139/DIG. 1

(58) Field of Classification Search ..... 139/383 R, 139/11, DIG. 1
See application file for complete search history.

(56) References Cited

U.S. PATENT DOCUMENTS 4,320,160 A * 3/1982 Nishimura et al. ..... 428/107
4,622,254 A * 11/1986 Nishimura et al. ..... 428/102

(Continued)

FOREIGN PATENT DOCUMENTS

EP 0 335 011 10/1989

(Continued)

OTHER PUBLICATIONS

International Search Report for International Application No. PCT/JP2007/059145 dated May 29, 2007.

*Primary Examiner*—Bobby H Muromoto, Jr.
(74) *Attorney, Agent, or Firm*—RatnerPrestia

(57) ABSTRACT

The present invention has an object of providing a method for producing a carbon fiber woven fabric in which the length of each warp yarn made of a carbon fiber strand is uniform, weft yarns are straightly arranged without waviness, and that is excellent in quality can be obtained with high productivity (production speed), and is characterized that a method for producing a carbon fiber woven fabric using an air jet loom in which heald in a shedding motion has an angle of repose in a range of 0 to 50° when weaving a uni-directional carbon fiber woven fabric woven with a carbon fiber strand having a fineness of 400 to 6,000 tex as the warp yarn and an auxiliary fiber having a fineness of ⅕ or less of the carbon fiber strand as the weft yarn.

18 Claims, 6 Drawing Sheets

U.S. PATENT DOCUMENTS

| | | | | |
|---|---|---|---|---|
| 4,770,929 | A * | 9/1988 | Nobumasa et al. | 442/278 |
| 4,786,541 | A * | 11/1988 | Nishimura et al. | 428/102 |
| 4,906,506 | A * | 3/1990 | Nishimura et al. | 428/113 |
| 4,957,144 | A | 9/1990 | Watanabe et al. | |
| 5,100,713 | A * | 3/1992 | Homma et al. | 428/102 |
| 5,396,932 | A * | 3/1995 | Homma et al. | 139/420 A |
| 5,455,107 | A * | 10/1995 | Homma et al. | 442/60 |
| 5,538,049 | A * | 7/1996 | Homma et al. | 139/450 |
| 5,662,146 | A * | 9/1997 | Homma et al. | 139/97 |
| 5,783,278 | A * | 7/1998 | Nishimura et al. | 428/102 |
| 5,789,073 | A * | 8/1998 | Odagiri et al. | 428/297.4 |
| 5,897,447 | A * | 4/1999 | Nishihara | 473/535 |
| 5,910,456 | A * | 6/1999 | Matsuhisa et al. | 442/179 |
| 5,960,834 | A * | 10/1999 | Sekido et al. | 138/125 |
| 6,277,771 | B1 * | 8/2001 | Nishimura et al. | 442/229 |
| 6,287,696 | B1 * | 9/2001 | Noda et al. | 428/411.1 |
| 6,995,099 | B1 * | 2/2006 | Nishimura et al. | 442/59 |
| 2001/0024722 | A1 * | 9/2001 | Matsuhisa et al. | 428/364 |
| 2004/0130072 | A1 * | 7/2004 | Sekido et al. | 264/408 |
| 2004/0170554 | A1 * | 9/2004 | Wadahara et al. | 423/447.2 |
| 2004/0241415 | A1 * | 12/2004 | Wadahara et al. | 428/298.1 |
| 2009/0068428 | A1 * | 3/2009 | Shinoda et al. | 428/212 |

FOREIGN PATENT DOCUMENTS

| | | |
|---|---|---|
| JP | 47-309001 | 9/1972 |
| JP | 63-110584 | 7/1988 |
| JP | 01-174413 | 7/1989 |
| JP | 01-174645 | 7/1989 |
| JP | 01-280045 | 11/1989 |
| JP | 02-118141 | 5/1990 |
| JP | 03-241030 | 10/1991 |
| JP | 04-119164 | 4/1992 |
| JP | 06-341034 | 12/1994 |
| JP | 07-279002 | 10/1995 |
| JP | 08-246296 | 9/1996 |
| JP | 08-325943 | 12/1996 |
| JP | 11-001839 | 1/1999 |
| JP | 11-012891 | 1/1999 |
| JP | 2000-8241 | 1/2000 |
| JP | 2001-303396 | 10/2001 |
| JP | 2002-138344 | 5/2002 |
| JP | 2003-268656 | 9/2003 |

* cited by examiner

【Fig. 1】
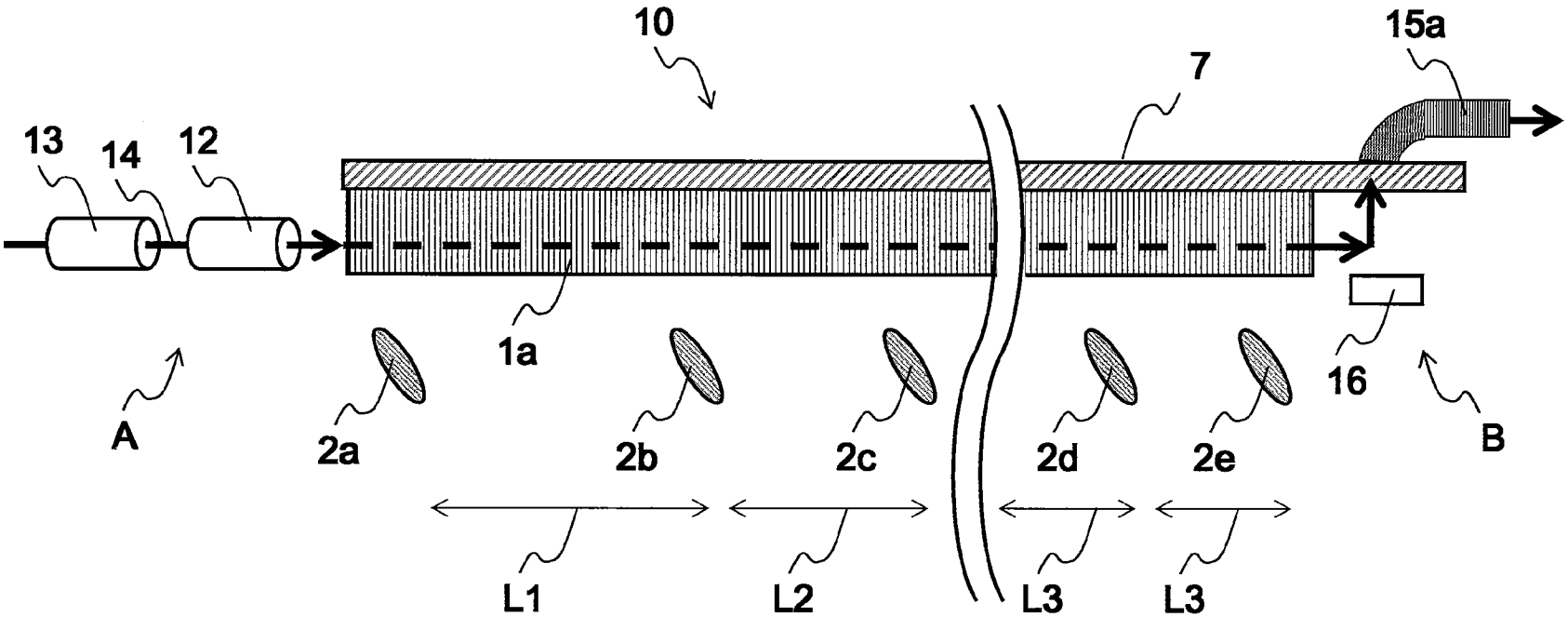

【Fig. 2】
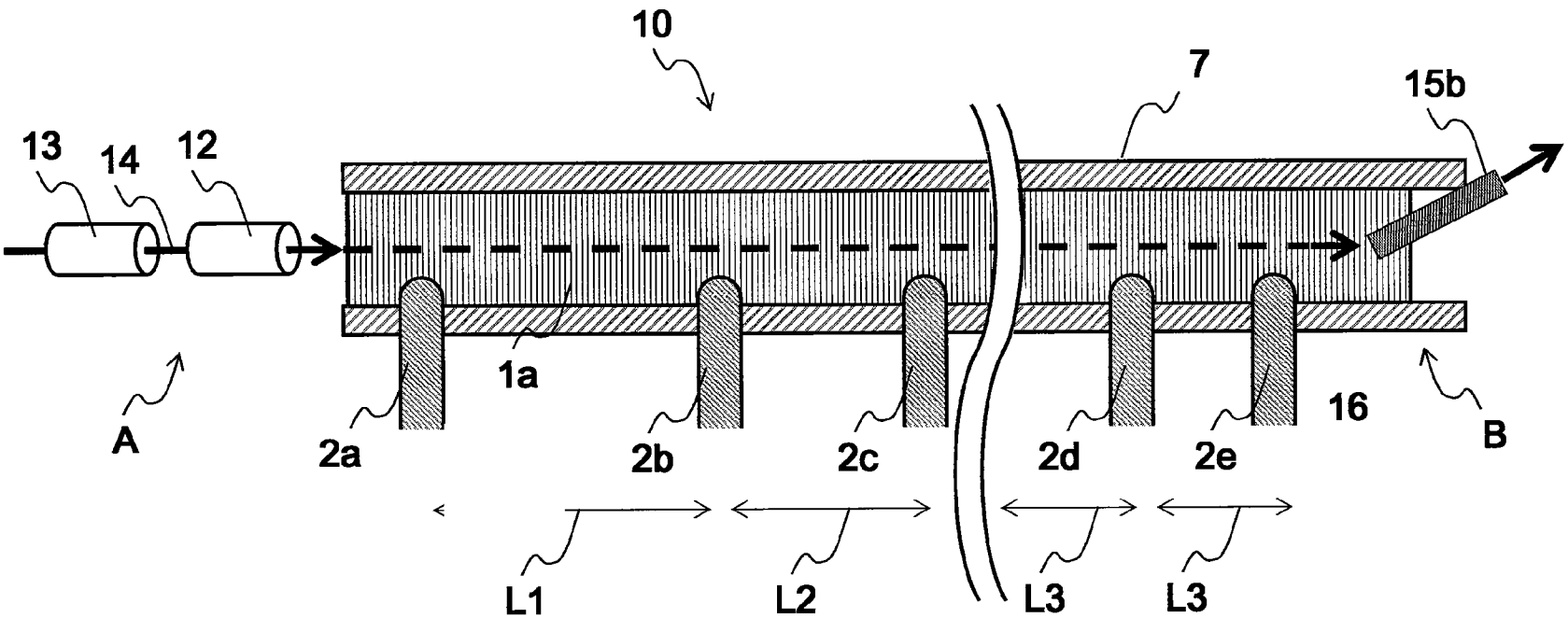

【Fig. 4】
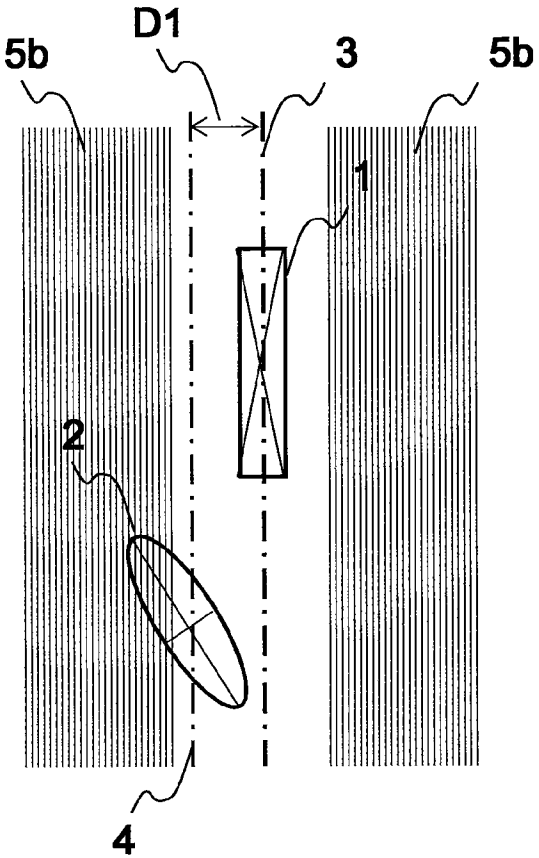
【Fig. 3】
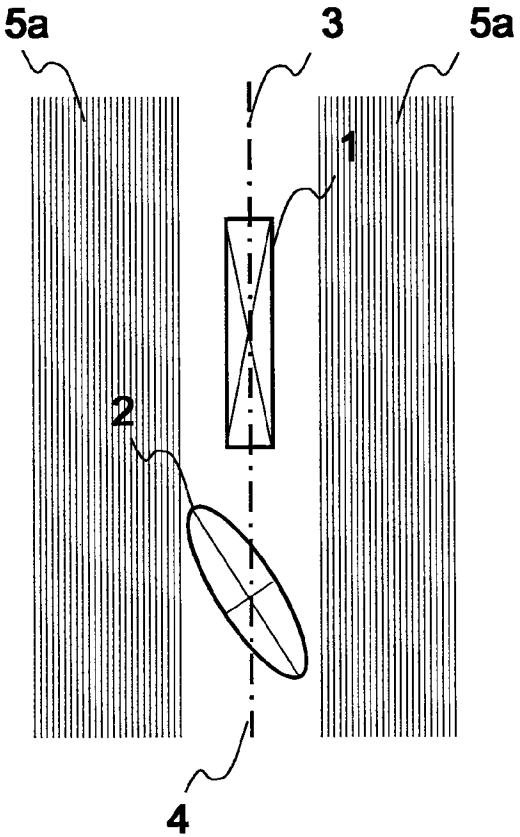

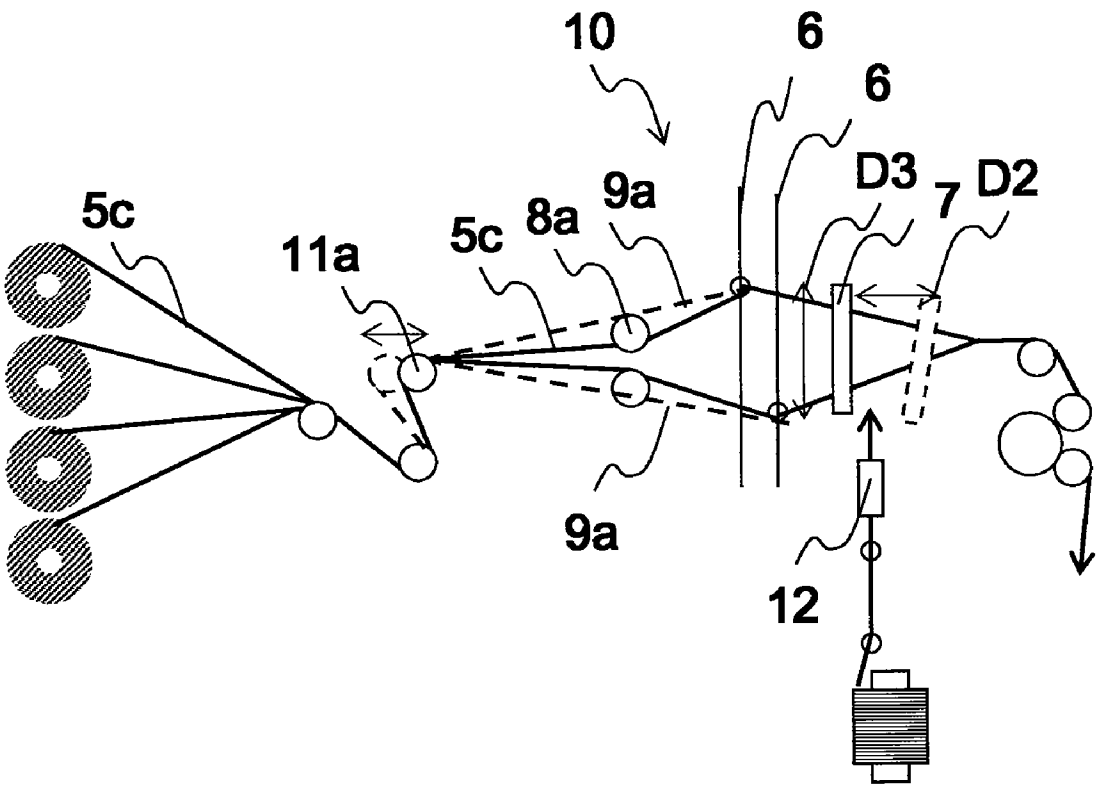
【Fig. 5】

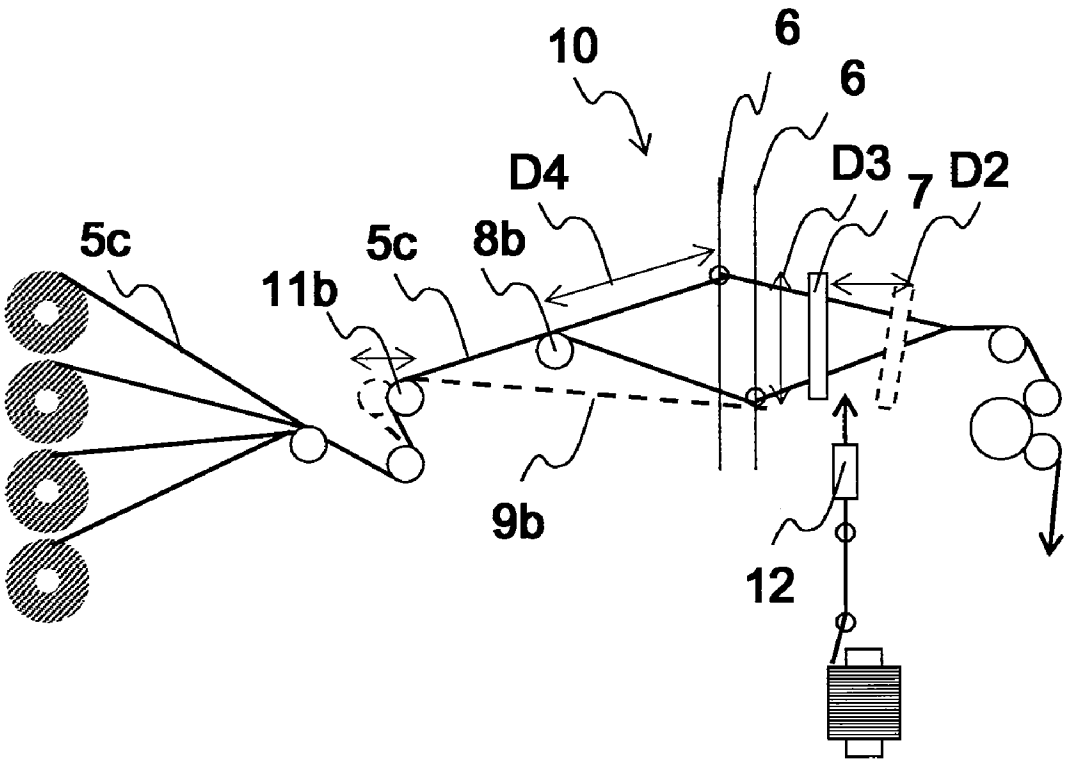
【Fig. 6】

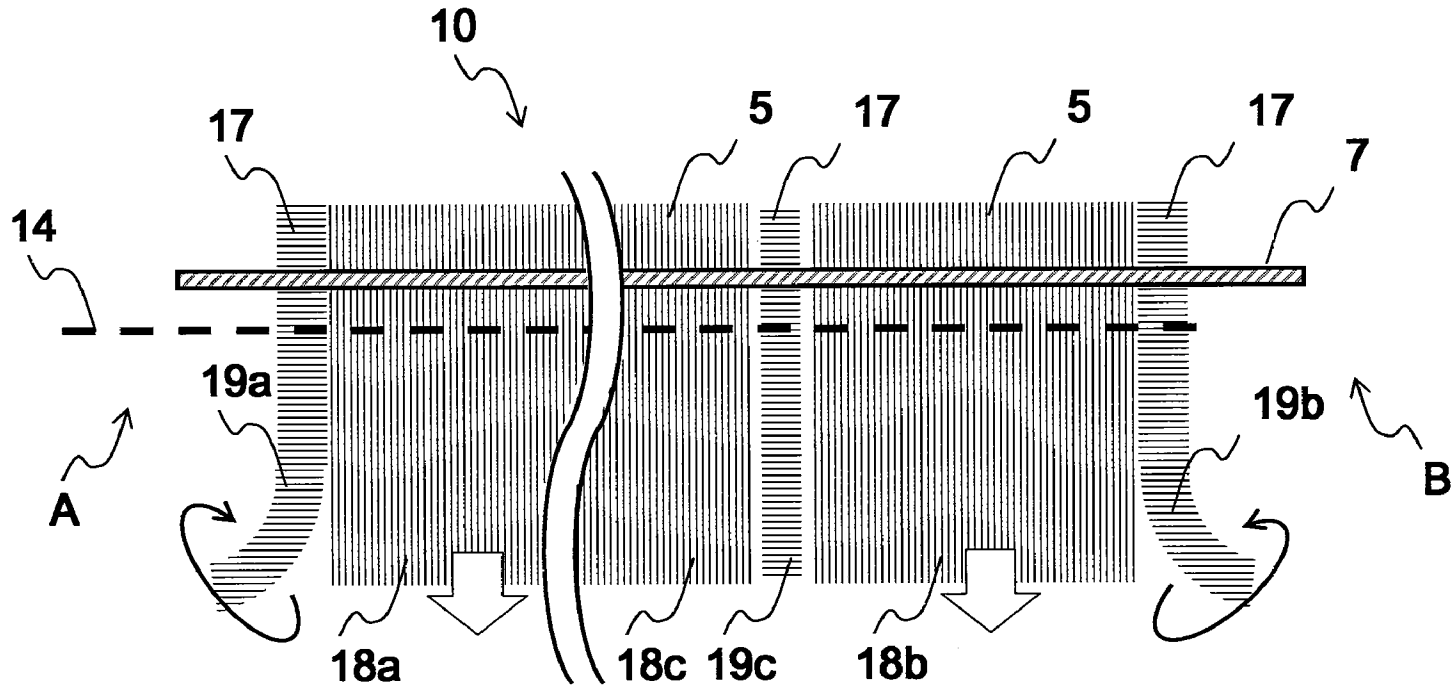
【Fig. 7】

METHOD FOR PRODUCING CARBON FIBER WOVEN FABRIC

This is a U.S. National Phase Application of PCT International Application No. PCT/JP2007/059145, filed Apr. 27, 2007 (incorporated by reference herein in its entirety), and claims priority of JP 2006-124868, filed Apr. 28, 2006.

FIELD OF THE INVENTION

The present invention relates to a method for producing a uni-directional carbon fiber woven fabric in which each warp strand made of a carbon fiber strand is uniform and weft strands are straightly aligned without waviness, and that is excellent in quality. Particularly, it relates to a method for producing a carbon fiber woven fabric that can produce a carbon fiber woven fabric in which the length of each warp yarn made of a carbon fiber strand is uniform and a weft yarn is straightly aligned without waviness while remarkably improving productivity (production speed).

BACKGROUND OF THE INVENTION

Conventionally, there has often been the case where a glass fiber woven fabric is woven using an air jet loom as in Patent Documents 1 and 2 for example. This is because industrial weaving has become possible due to satisfaction of the following conditions: fuzz is hardly generated because the breaking elongation of the glass fiber used is as high as about 4%, its fineness is as small as 8 to 100 tex for example, and the weaving density (the number of warp strands, the number of weft strands) is high, and the woven fabric to be woven is a bi-directional woven fabric in which the glass fiber is arranged in two directions.

On the other hand, there has often been the case where a carbon fiber woven fabric is woven using a shuttle loom, a rapier loom, or the like as in Patent Document 3 for example. This is because it has been considered that it is difficult to actually industrially weave a carbon fiber using an air jet loom for the reasons that there is no explanation of a specific method of specifically weaving the carbon fiber by an air jet loom, fuzz is generated easily because the breaking elongation of the carbon fiber is as low as about 1.5 to 2%, and its fineness is as large as 333 to 3,333 tex for example, and the weaving density is low, although in Patent Document 1, the air jet loom is shown as one example of the looms, and a woven fabric made of an inorganic fiber such as a carbon fiber is described as one example of the woven fabrics.

However, in manufacturing the carbon fiber woven fabric using the shuttle loom or a rapier loom, high productivity, that is, high production speed (the rotation speed of the loom), could not be achieved due to the following reasons.

A. Limitations of the Weaving Machinery of the Loom (1) In the case of using a shuttle loom or a rapier loom, an upper limit of the physical speed exists in the movement of inserting the weft yarn by the shuttle or the rapier.

(2) In the insertion of the weft yarn, the warp yarns are scratched by directly making contact with the shuttle or the rapier during weaving at high rotation speed, and fuzz of the carbon fiber strand is easily generated.

(3) In the supplying of the warp yarn, the warp yarns that are adjacent to each other are scratched by the shedding motion of the warp yarn during weaving at high rotation speed, and fuzz of the carbon fiber strand is easily generated.

B. Limitations of the Woven Fabric to be Woven (1) In the case of a bi-directional woven fabric in which a carbon fiber strand is used as the warp yarn and the weft yarn, as to the insertion of the weft yarn, the warp yarns and the weft yarns are scratched by directly making contact with each other during weaving at high rotation speed, and fuzz of the carbon fiber strand is easily generated, depending on the loom used or the weaving conditions.

C. Limitations of the Carbon Fiber Used (1) Fuzz is generated easily because the breaking elongation of the carbon fiber strand is low.

Further, in the case of weaving by the shuttle loom or the rapier loom, it is difficult to make the an angle of repose of heald in a shedding motion small; because of that, fluctuation of the warp yarn tension becomes large, and there is a problem that unevenness that cannot be ignored is easily generated in the woven carbon fiber woven fabric. Especially, in a carbon fiber woven fabric, a uni-directional woven fabric in which the carbon fiber strands with large fineness are used as the warp yarn and auxiliary strands with small fineness (for example, a glass fiber yarn) are used as the weft yarn has been used broadly in the use of repairing and reinforcing a concrete structure or the like, for example. However, while weaving such a uni-directional woven fabric, in each step of weaving, driving, and winding of the carbon fiber woven fabric, the weft yarn that has small fineness is easily slipped by the warp yarn that is the carbon fiber strands having large fineness and that moves slightly, and there is a problem that the weft yarn is waved (distorted) and cannot be aligned straight.

Moreover, for the above-described productivity problem, a content of producing a carbon fiber woven fabric by a water jet loom that uses water is disclosed in Patent Document 4. In this document, there is a description that a carbon fiber woven fabric having a plain weaving structure in which both of the warp yarn and the weft yarn are constituted with a carbon fiber can be produced at a speed of 0.8 m/min using a carbon fiber having a fineness of 200 tex. However, when a carbon fiber woven fabric is woven using water, a surface treatment agent (such as a sizing agent or a coupling agent) that is given to the carbon fiber strands is flowed out or deteriorated by the water, and there is a problem that it is difficult to obtain physical properties that are desired for the woven carbon fiber woven fabric (same problem occurs in the glass fiber woven fabric). Further, there is also a problem in treatment of liquid wastes in which the surface treatment agent is dissolved. Therefore, production of a carbon fiber woven fabric by the water jet loom is not practical as an industrial weaving method.

As such, a method for producing a carbon fiber woven fabric that achieves high productivity has not been found in the conventional techniques such as in Patent Documents 1 to 4, and such a production technique is eagerly desired.

Patent Document 1: Japanese Patent Application Laid-Open (JP-A) No. 2000-8241

Patent Document 2: JP-A No. 08-325943

Patent Document 3: JP-A No. 11-001839

Patent Document 4: JP-A No. 06-341034

SUMMARY OF THE INVENTION

Accordingly, an aspect of the present invention is to solve the problems described in the above-described background art, and to provide a method for producing a carbon fiber woven fabric that can produce a carbon fiber woven fabric in which the length of each warp yarn made of a carbon fiber strand is uniform and a weft yarn is straightly aligned without waviness, and that is excellent in quality with high productivity (production speed).

Embodiments of the present invention may have any configuration of the following (1) to (19).

(1) A method for producing a uni-directional carbon fiber woven fabric woven with a carbon fiber strand having a fineness of 400 to 6,000 tex as a warp yarn and an auxiliary fiber having a fineness of ⅕ or less of the carbon fiber strand as a weft yarn, wherein the uni-directional carbon fiber woven fabric is produced by an air jet loom in which heald in a shedding motion has an angle of repose in a range of 0 to 500.

(2) The production method according to (1), wherein the warp yarn density of the carbon fiber woven fabric is 1 to 8 strands/cm and the weft yarn density thereof is 0.4 to 8 strands/cm.

(3) The production method according to (1) or (2), wherein a different weaving structure is simultaneously woven at least in an end that is the opposite side from the weft yarn insertion side of the woven carbon fiber woven fabric using the weft yarn weaving the carbon fiber woven fabric, and a twist is given to the different weaving structure after cutting the weft yarn between the different weaving structure and the carbon fiber woven fabric to separate the different weaving structure from the carbon fiber woven fabric.

(4) The production method according to (3), wherein the twist is given to the different weaving structure by passing the different weaving structure through a guide having a hole and rotating the guide.

(5) The production method according to (3) or (4), wherein the different weaving structure is led so that the distance between the different weaving structure and the carbon fiber woven fabric becomes broad while weaving or after weaving the different weaving structure.

(6) The production method according to any one of (3) to (5), wherein the carbon fiber woven fabric has a plain weaving structure, a twill weaving structure, or a satin weaving structure, and the different weaving structure has a plain weaving structure, a leno weaving structure, or a structure as a combination thereof.

(7) The production method according to any one of (1) to (6), wherein a tubular body is arranged in a side that is the opposite side from the weft yarn insertion side of the woven carbon fiber woven fabric so that the axis crosses with the running direction of the weft yarn, or a tubular body whose axis is curved is arranged in a side that is the opposite side from the weft yarn insertion side of the woven carbon fiber woven fabric, and the weft yarn inserted to weave the carbon fiber woven fabric is passed through from one opening port to the other opening port of the tubular body.

(8) The production method according to any one of (1) to (7), wherein the air jet loom has one main nozzle and a plurality of sub-nozzles that eject air, each sub-nozzle is arranged at an interval of one per a woven fabric width of 2 to 15 cm in the downstream side of the main nozzle in the running direction of the weft yarn, the air jet loom has an auxiliary main nozzle that ejects air in the upstream side of the main nozzle in the running direction of the weft yarn, and the weft yarn is run by ejecting air from these nozzles.

(9) The production method according to any one of (1) to (8), wherein the shedding motion stroke amount of the heald in the air jet loom is in a range of 10 to 75 mm.

(10) The production method according to any one of (1) to (9), wherein the shedding motion of the warp yarn introduced into the heald is at least partially limited.

(11) The production method according to any one of (1) to (10), wherein the air jet loom has a plurality of sub-nozzles that eject air, and each sub-nozzle is arranged so that the center of the sub-nozzle and the center of the dent exist on substantially the same straight line parallel to the longitudinal direction of the woven fabric.

(12) The production method according to any one of (1) to (11), wherein the dent thickness of a reed in the air jet loom is in a range of 0.1 to 2 mm.

(13) The production method according to any one of (1) to (12), wherein the beating stroke amount in the air jet loom is in a range of 50 to 150 mm.

(14) The production method according to any one of (1) to (13), wherein the air jet loom has a plurality of sub-nozzles that eject air, the reed width is in a range of 100 to 350 cm, and the distance between the sub-nozzle in the far end part of the side that is the opposite side from the weft yarn insertion side and the sub-nozzle adjacent thereto is shorter than the distance between the sub-nozzle in the far end part of the weft yarn insertion side and the sub-nozzle adjacent thereto.

(15) The production method according to any one of (1) to (14), wherein the reed width in the air jet loom is in a range of 100 to 350 cm, and a selvedge structure is formed in the reed width but except at both ends of the reed width.

(16) The production method according to any one of (1) to (15), wherein the weft yarn is at least one type selected from a group consisting of a spun yarn of a glass fiber and an organic fiber, spun yarn of a glass fiber, a spun yarn of an organic fiber, an interlace textured yarn of a glass fiber and an organic fiber, an interlace textured yarn of a glass fiber, and an interlaced textured yarn of an organic fiber.

(17) The production method according to any one of (1) to (16), wherein the weft yarn is a covering yarn made by covering a glass fiber as a core yarn with a filament yarn of an organic fiber.

(18) The production method according to any one of (1) to (17), wherein the woven carbon fiber woven fabric is wound once in a prescribed length L1, and the wound carbon fiber woven fabric is re-wound by dividing into a product length L2 that is a half or less of the prescribed length L1.

(19) The production method according to any one of (1) to (18), wherein the carbon fiber strand that is the warp yarn is unwound from a bobbin and parallelized, and is directly led to the air jet loom.

According to aspects of the present invention, productivity can be improved by weaving a unidirectional carbon fiber woven fabric using an air jet loom that has been considered not to be practical for the industrial production of a carbon fiber woven fabric, and the warp yarn length of the carbon fiber strand can be made uniform by making the angle of repose of heald in the shedding motion in a range of 0 to 50°. Furthermore, a carbon fiber woven fabric in which weft yarns are straightly aligned without waviness and that is excellent in quality can be produced even in weaving using the air jet loom which can hardly give tension to the weft yarn when it is inserted.

BRIEF DESCRIPTION OF THE DRAWINGS

FIG. 1 is a schematic planar drawing showing a positional relationship of various nozzles and a tubular body in an air jet loom which can be used in one embodiment of the present invention.

FIG. 2 is a schematic front drawing showing a positional relationship of a different mode of the various nozzles and the tubular body in the air jet loom which can be used in one embodiment of the present invention.

FIG. 3 is a schematic planar drawing showing a positional relationship of sub-nozzles and a dent in the air jet loom which can be used in one embodiment of the present invention.

FIG. 4 is a schematic planar drawing showing a positional relationship of sub-nozzles and the dent in the air jet loom which can be used in one embodiment of the present invention.

FIG. 5 is a schematic cross-sectional drawing showing one example of a yarn path in the air jet loom which can be used in one embodiment of the present invention.

FIG. 6 is a schematic cross-sectional drawing showing a different example of the yarn path in the air jet loom which can be used in one embodiment of the present invention.

FIG. 7 is a schematic planar drawing showing one example of weaving in one embodiment of the present invention.

DESCRIPTION OF THE REFERENCE NUMERALS

1 Dent
1*a* Dent group
2, 2*a*, 2*b*, 2*c*, 2*d*, 2*e* Sub-nozzle
3 Center line of dent to longitudinal direction of woven fabric
4 Center line of sub-nozzle to longitudinal direction of woven fabric
5, 5*a*, 5*b*, 5*c* Warp yarn
6 Heald
7 Reed
8*a*, 8*b* Pressing bar
9*a*, 9*b* Yarn path in the case where there is no pressing bar
10 Air jet loom
11*a*, 11*b* Easing roll
12 Main nozzle
13 Auxiliary main nozzle
14 Weft yarn
15*a* Curved tubular body
15*b* Tubular body arranged in a direction having an angle with weft yarn running direction
16 Stretch nozzle
17 warp yarn of different weaving structure
18*a*, 18*b*, 18*c* Carbon fiber woven fabric
19*a*, 19*b* Different weaving structure
19*c* Selvedge structure
A Weft yarn insertion side
B Opposite-to-weft-yarn-insertion side
D1 Difference of center of sub-nozzle and center of dent to the longitudinal direction of woven fabric
D2 Beating stroke amount
D3 shedding motion stroke amount of heald
D4 Warp yarn length from a place where warp yarn starts opening to heald
L1, L2, L3 Interval of arrangement between two sub-nozzles

DETAILED DESCRIPTION OF THE INVENTION

In an embodiment of the present invention, an air jet loom is used when producing a uni-directional carbon fiber woven fabric using a carbon fiber strand having a fineness of 400 to 6,000 tex as the warp yarn and an auxiliary fiber having a fineness of ⅕ or less of the carbon fiber strand as the weft yarn.

As described above, in the case of producing the carbon fiber woven fabric by a shuttle loom or a rapier loom, there are problems (problems in items (1) and (2) of the above-described A) such that (1) in the case of using the shuttle loom or the rapier loom, an upper limit of the physical speed exists in the movement of inserting the weft yarn by the shuttle or the rapier, and (2) in the insertion of the weft yarn, the warp yarns are scratched by directly making contact with the shuttle or the rapier during weaving at high rotation speed, and fuzz of the carbon fiber strand is easily generated. However, by using an air jet loom, there is no influence of the physical speed of a shuttle or a rapier, and scratching of the warp yarn with the shuttle or the rapier is not essentially generated. Here, when a water jet loom is used, there is a fear that unevenness in the falling and attaching amount of a sizing agent (most sizing agents are water-soluble resin compositions), that is attached to the carbon fiber strand as the weaving yarn in advance, is caused, and there is a problem that a step of drying the woven fabric afterward becomes necessary.

In weaving using such an air jet loom, the healds in their shedding motion have the angle of repose in a range of 0 to 50°, preferably 0 to 25°, and more preferably 0°. The smaller such an angle of repose of heald is, the more preferable it is.

The angle of repose of heald in the shedding motion is an angle of the range where there is no movement continuously in displacement in the shedding motion (displacement) of the heald in the case where one cycle of a repeating movement of the loom in which the weft yarn is inserted is divided up and assigned to the rotation angle of the motor main axis (crank) of the loom, that is, 360 degrees.

When a general shuttle loom, a rapier loom, or the like is used, there is a case where the shuttle or the rapier that is a means of inserting the weft yarn locally contacts with a group of the weft yarns, and tension to each yarn that is applied during weaving cannot be made uniform. Further, in order to insert the shuttle or the rapier into a shed, the shedding motion amount of the heald has to be made large and the heald has to be still in a condition of opening while the shuttle or the rapier is moving. Because of that, the angle of repose of heald in the shedding motion is 150 to 2200 in a general rapier loom for example. Accordingly, the movement of weaving becomes an intermittent movement (discontinuous movement), and not only the warp yarn becomes unstable by being stretched or getting loose, but also it is one cause of making the tension to each warp yarn non-uniform. Being caused by this, not only it is impossible to make the difference in the warp yarn length in the obtained carbon fiber woven fabric 0.15% or less and to make the fluctuation coefficient of the warp yarn length 8% or less, but also the scratching of the carbon fiber strands and the heald becomes large because the warp yarn that has been stopped starts moving and a lot of fuzz is generated, and therefore it is difficult to obtain a woven fabric that is excellent in quality. On the other hand, there is no necessity to keep the heald opened for a long time in the air jet loom. That is, by using the air jet loom, because there exists not even slight physical contact between the means of inserting the weft yarn and a group of the warp yarns, and there is no necessity to make the heald still for a long time in order to keep the heald opened, the angle of repose of heald in a shedding motion can be set in the range of 0 to 50°, and the tension to each warp yarn that is applied during weaving can be made more uniform. As a result, a carbon fiber woven fabric can be easily obtained in which the difference in the warp yarn length is 0.15% or less and the fluctuation coefficient of the warp yarn length is 8% or less. The difference in the warp yarn length is more preferably 0.1% or less, and even more preferably 0.05% or less. Further, the fluctuation coefficient is more preferably 6% or less, and further preferably 4% or less. When the difference in the warp yarn and its fluctuation coefficient are in the above-described range, not only is the appearance quality excellent with the unevenness of the woven fabric in the case where the woven fabric is unwound on a floor being kept to minimum, but also excellent mechanical properties are exhibited when the obtained woven fabric is formed into a CFRP. The difference in the warp yarn length and the fluctuation coefficient of the warp yarn length are measured according to the following procedure.

(a) 5,500 mm of a carbon fiber woven fabric is unwound so that it does not go slack, and is kept still under no tension.

(b) As a standard for measurement, one part of the unwound woven fabric is cut vertically to the longitudinal direction.

(c) 5,000 mm of the yarn length is measured for each warp yarn in the both end parts in the width direction of the woven fabric from the standard for measurement, and it is cut in a line connecting the measured points. In the length measurement, the length of 5,000 mm is measured with a long scale measure by unwinding the woven fabric so that it does not go slack and keeping still under no tension.

(d) A warp yarn is pulled out of every 5 strands in order over the entire width of the woven fabric while taking the woven fabric apart.

(e) The length of each warp yarn pulled out is measured to the order of 0.1 mm. In the length measurement, it is measured with a long scale measure while applying tension of the level of pulling with a hand so that the warp yarn does not wave.

(f) The difference between the maximum value and the minimum value of the measured warp yarn length is calculated. The calculated difference is divided by 5,000 mm and multiplied by 100, and this value is regarded as the difference in the warp yarn length (unit is %).

(g) A standard deviation and an average value are calculated for all values of the measured warp yarn length. The value of which the calculated standard deviation is divided by the calculated average value and multiplied by 100 is regarded as a fluctuation coefficient (unit is %).

Originally, the air jet loom has been used in industrial production of a bi-directional woven fabric of glass fibers. However, the reason is not only that the breaking elongation of the glass fibers that are used is as high as about 4% and it is difficult for fuzz to be generated. Besides, it is because of satisfaction of the following conditions: leak of the air ejected during running of the weft yarn can be made minimum and the waviness (distortion) of the weft yarn does not become obvious because the object of the loom is a woven fabric in which the fineness of the glass fibers that are used is as thin as 8 to 100 tex for example and the weaving density (the number of the warp strands, the number of the weft strands) is high (FUTURE TEXTILES, p 81 to 84, Teruo Hori, Sen-i Co). On the other hand, according to aspects of the present invention, a plurality of disadvantageous obstacles for using the air jet loom clearly exists: fuzz is easily generated in the carbon fiber strands that is used and the fineness is large compared with the glass fibers and the woven fabric that is produced is a uni-directional woven fabric. Nevertheless, weaving by the air jet loom is realized in embodiments of the present invention by formulating a concept of weaving the uni-directional carbon fiber woven fabric by the air jet loom, and solving the above-described disadvantageous obstacles.

In the carbon fiber woven fabric produced in the present invention, the warp yarn density is preferably 1 to 8 strands/cm, and the weft yarn density is preferably 0.4 to 8 strands/cm. More preferably, the warp yarn density is in the range of 2 to 6 strands/cm, the weft yarn density is in the range of 1 to 6 strands/cm, and further preferably, the warp yarn density is in the range of 3 to 5 strands/cm, and the weft yarn density is in the range of 2 to 5 strands/cm. When the warp yarn density is too low, not only does the shape stability of the carbon fiber woven fabric deteriorate, but also the space between the warp yarns becomes too large and there is a case where the weft yarn insertion efficiency of the air jet loom decreases too much. On the other hand, when the warp yarn density becomes too high, as described in the above-described A (3), fuzz is generated a lot due to the scratching of the carbon fiber strands, and there is a case where the quality of the carbon fiber woven fabric is degraded. Further, when the weft yarn density is too low, the shape stability of the carbon fiber woven fabric deteriorates, and the handling property of the obtained woven fabric tends to deteriorate. On the other hand, when the weft yarn density is too high, not only is there a case where it becomes difficult to obtain a high production speed of the carbon fiber woven fabric, but also there is a case where waviness of the weft yarn cannot be suppressed.

The method for producing the carbon fiber woven fabric of the present invention is suitable for producing a carbon fiber woven fabric having a space between the warp yarns in the range of 0.1 to 0.8 mm, preferably 0.15 to 0.6 mm, and more preferably 0.2 to 0.5 mm. In the obtained woven fabric, when the space between the warp yarns is too small, as described in the above-described A (3), fuzz is generated a lot due to the scratching of the carbon fiber strands, and not only is there a case where the quality of the carbon fiber woven fabric is degraded, but also there is a case where impregnation of a matrix resin is hindered when forming a CFRP (carbon fiber reinforced plastic) by impregnating the matrix resin after weaving the carbon fiber woven fabric. In the case of using an air jet loom, because the sub-nozzle (to be described specifically in the following) projecting between the carbon fiber strands scratches the carbon fiber strands during weaving, there is a case where fuzz of the carbon fiber strand is generated more than expected. On the other hand, in the case where the space between the warp yarns is too large, the generation of fuzz is suppressed. However, there is a case where the weft yarn insertion efficiency decreases, and when the CFRP is formed, a large resin-rich part is formed, there is a case where mechanical properties of the CFRP are decreased.

In the present invention, a tubular body in which both ends are opened is preferably arranged on the opposite side from the weft yarn insertion side of the carbon fiber woven fabric to be woven (in the following, called "opposite-to-weft-yarn-insertion side"), and the weft yarn that is inserted and run to weave the carbon fiber woven fabric is preferably passed through from one opening port to the other opening port of the tubular body. Sagging of the weft yarn can be prevented by friction between the weft yarn and an inner wall of the tubular body. The tubular body may be one in which the axis is curved besides one in which the axis is straight, and the tubular body having a straight axis is arranged so that the axis crosses the running direction of the weft yarn (so that the axis does not become parallel with the running direction)

This configuration is specifically shown in FIGS. 1 and 2. FIG. 1 is a schematic planar drawing showing a positional relationship of various nozzles and the tubular body in the air jet loom. FIG. 2 is a schematic front drawing showing a positional relationship of a different mode of various nozzles and the tubular body. In both drawings, the warp yarn is omitted.

Air is ejected at least from a main nozzle 12 and sub-nozzles 2*a*, 2*b*, and the like in an air jet loom 10 in FIGS. 1 and 2, and a weft yarn 14 is run from a weft yarn insertion side A to an opposite-to-weft-yarn-insertion side B while passing through a group of dents 1*a*. After the weft yarn is inserted from the side, it is beaten in a reed 7, and the warp yarn and the weft yarn 14 are woven.

Here, the main nozzle is a nozzle arranged in the weft yarn insertion side of the loom and in which pressured air is given initially to the weft yarn that is to run, and the sub-nozzle is a nozzle which let pressured air acts as an auxiliary in order for the weft yarn that is run by the main nozzle to continue to run.

In the air jet loom used in the present invention, one of the main nozzles 12 is preferably arranged in the weft yarn insertion side A, and a plurality of the sub-nozzles 2*a*, 2*b*, and the like are preferably arranged at an interval of one sub-nozzle per width of the woven fabric of 2 to 15 cm between the weft yarn insertion side A and the opposite-to-weft-yarn-insertion side B. The preferable arrangement interval of the sub-nozzles is one per width of the woven fabric of 3 to 12 cm, and more preferably one per width of the woven fabric of 4 to 10 cm. Further, the total number of sub-nozzles differs depending on the width of the woven fabric. However, it is preferably 7 to 30 in the case where the width of the woven fabric is 100 cm, and it is preferably in the range of 23 to 105 in the case where the width of the woven fabric is 350 cm.

In the arrangement of this plurality of sub-nozzles 2*a*, 2*b*, and the like, especially in the case where the reed width of the air jet loom is a broad range (the reed width is in the range of 100 to 350 cm) described in the following, the distance between the sub-nozzle that is in the far end part in the opposite-to-weft-yarn-insertion side B and the sub-nozzle adjacent thereto is preferably made to be shorter than the distance between the sub-nozzle that is in the far end part in the weft yarn insertion side A and the sub-nozzle adjacent thereto. Specifically, they are preferably arranged so that the arrangement intervals between the sub-nozzles L2, L3 facing to the opposite-to-weft-yarn-insertion side B do not become larger than the arrangement interval L1 between the sub-nozzles in the weft yarn insertion side A. They are more preferably arranged so that the arrangement interval between the sub-nozzles becomes shorter along the weft yarn insertion direction. When the plurality of the sub-nozzles 2*a*, 2*b*, and the like are arranged in such a mode, not only can air from the main nozzle 12 be used efficiently, but also the running of the weft yarn can be stabilized in the opposite-to-weft-yarn-insertion side B, and the insertion of the weft yarn itself can be performed with stability for a long period of time. Of course, the relationship between such arrangement intervals L1 to L3 of the sub-nozzles is appropriately selected depending on the woven fabric width. However, it may be L1>L2>L3 or may be L1>L2=L3, for example.

Furthermore, in one embodiment of the present invention, the air jet loom may also be used in which a plurality of main nozzles that are arranged in the weft yarn insertion side exist. For example, the air jet loom is preferably used having another main nozzle (auxiliary main nozzle 13) in the far upstream side of the weft yarn running direction from the main nozzle 12 arranged in the weft yarn insertion side A. More preferably, the weft yarn is preferably run by ejected air at substantially the same time from each of the main nozzle 12 and the auxiliary main nozzle 13. By using such an auxiliary main nozzle 13, it becomes unnecessary to run the weft yarn by ejecting rapid air onto the weft yarn that is standing by for the next insertion. That is, in the case of having one main nozzle, the pressure of the air has to be necessarily high because the weft yarn is run by ejecting the air onto one part of the weft yarn. However, in the case of using the auxiliary main nozzle 13 together and using a plurality of main nozzles, the air pressure can be decreased because the weft yarn is run by ejecting air on a plurality of parts on the weft yarn. Because of this, not only cutting of the weft yarn, breaking and loosening of the weft yarn, fuzz of the weft yarn, and the like can be suppressed, but also the weft yarn that is difficult to be run can be run, and a degree of freedom in the selection of the weft yarn can be broaden. Here, ejecting air at substantially the same time is to eject air with a main axis (crank) angle of the loom being in the range of 20° or less.

Further, in the air jet loom, each sub-nozzle is preferably arranged so that the center of the sub-nozzle and the center of the dent exist on substantially the same straight line parallel to the longitudinal direction of the woven fabric. In other words, as shown in FIGS. 3 and 4 that show the position relationship of the sub-nozzle and the dent and that are partially magnified drawings of the air jet loom, the center of the sub-nozzle 2 that eject air and the center of the dent 1 are preferably provided so as to be in substantially the same position with regard to the width direction of the woven fabric.

In one embodiment of the present invention, the center of the sub-nozzle and the center of the dent exist on substantially the same straight line parallel to the longitudinal direction" includes a mode that they are out of position a little as shown in FIG. 4 as long as the problem described in the following is not caused, not mentioning a condition that they exist on the same straight line completely parallel to the longitudinal direction. Specifically, it indicates that a deviation D1 with regard to the width direction of the woven fabric of the center of the sub-nozzle 2 and the center of the dent 1 is in a range of 0 to 3 mm. More specifically, D1 is shown by a distance between a center line 4 of the sub-nozzle with regard to the width direction of the woven fabric and a center line 3 of the dent with regard to the width direction of the woven fabric. When the center of the sub-nozzle 2 and the center of the dent 1 are not arranged on substantially the same straight line, because the sub-nozzle 2 scratches the warp yarn 5*b* (carbon fiber strand), there is a case where the generation of fuzz in the carbon fiber strand cannot be suppressed. That is, only when the center of the sub-nozzle 2 and the center of the dent 1 are arranged on substantially the same straight line, scratching with the warp yarn 5*a* can be suppressed.

The dent thickness of the reed is in a range of 0.1 to 2 mm, preferably in a range of 0.3 to 0.8 mm, and more preferably in a range of 0.4 to 0.7 mm. When the dent thickness is too small, the difference in the physical dimension of the sub-nozzle 2 becomes too large, and there is a case where the sub-nozzle 2 is projected too much and scratches the warp yarn 5. On the other hand, when the dent thickness is too large, not only does the weight of the reed itself become too large, but also the yarn path where the warp yarn 5 passes between the dents 1 become narrow, and there is a case where the dent 1 and the warp yarn 5 scratch too strongly.

Next, FIGS. 5 and 6 are schematic cross-sectional drawings each showing one example of the air jet loom.

The beating stroke amount D2 in the air jet loom is in a range of 50 to 150 mm, preferably in a range of 60 to 130 mm, and more preferably in a range of 70 to 90 mm. When the beating stroke amount D2 is too small, there is a case where a space for inserting the weft yarn cannot be formed. On the other hand, when the beating stroke amount D2 is too large, the motion of the beating itself becomes too large, and not only is there a case where obtaining a high speed of operation, that is an object of the present invention, is hindered, but also the scratch between the carbon fiber strand and the dent becomes large, and there is a case where fuzz from the carbon fiber strand cannot be suppressed. Here, the beating stroke amount D2 refers to the distance of a straight line connecting the reed position that is moved forward the most (during beating) and the reed position that is backed the most (during the weft yarn insertion).

Further, against the limitation in the above-described A (3), the shedding motion stroke amount of the heald D3 in the air jet loom is in a range of 10 to 75 mm, preferably in a range of 20 to 65 mm, and more preferably in a range of 30 to 60 mm. When the shedding motion stroke amount of the heald D3 is in such a range, scratch between the adjacent yarns can be minimized and the generation of fuzz of the carbon fiber strand can be suppressed during weaving at high rotation. More specifically, when the shedding motion stroke amount is too large, the absolute value of the tension of the warp yarn becomes high, and therefore a lot of fuzz of the carbon fiber strand is generated; when the opening amount is too small, formation of the shed (the space where the weft yarn passes) is not sufficient, and not only can the insertion of the weft yarn not be performed with stability, but also scratching of the warp yarn and the weft yarn becomes relatively strong, and there is a case where fuzz is generated. Here, the shedding motion stroke amount of the heald D3 refers to a straight distance connecting a position of mails of the heald at the top dead center of the shedding motion and a position of mails of the heald at the bottom dead center of the shedding motion.

A pressing bar that suppresses at least partially the shedding motion of the warp yarn introduced into the heald is preferably provided in the air jet loom. As specifically shown in FIGS. 5 and 6, pressing bars 8*a* and 8*b* refer to pressing bars that are provided between easing rolls 11*a* and 11*b* and the heald 6 (an intermediate peg), that presses the warp yarn 5*c* introduced in the heald 6 through the easing rolls 11*a* and 11*b*, and that play a role of suppressing the shedding motion of the warp yarn 5*c* to be smaller than the shedding motion formed in the original yarn paths 9*a* and 9*b* in the case where there are no pressing bars 8*a* and 8*b*. That is, they refer to the pressing bars that suppress the shedding motion by the warp yarn to be smaller. By suppressing at least partially the shedding motion of the warp yarn introduced into the heald, scratching between the adjacent warp yarns 5*c* due to the shedding motion can be further decreased.

Here, "suppressing at least partially" means that the all of the openings may be suppressed by pressing all of a plurality of the warp yarns 5*c* as shown in FIG. 5 or some of the opening may be suppressed by pressing some of the plurality of the warp yarns 5*c* as shown in FIG. 6.

The pressing bars 8*a* and 8*b* may be ones that can suppress the openings, and examples include various modes such as a free rotation roll (especially, a roll whose surface is pear-skin-finished), a fixed roll (especially, a roll whose surface is mirror-like finished), a pipe, a beam, and a bar. From the viewpoint of minimizing scratching between the warp yarn and the pressing bar, it is preferably a free rotation roll that is pear-skin-finished.

Furthermore, in order to maximally achieve the above-described effects, an easing mechanism (corresponding to the easing rolls 11*a* and 11*b* whose position can be changed in FIGS. 5 and 6) absorbing a fluctuation of the tension of the warp yarn is preferably equipped between the intermediate pegs. With such an easing mechanism, a stable and uniform tension of the warp yarn can be achieved especially even in the case where the warp yarn length D4 that is from a point where the warp yarn starts opening to the heald is made short in order to decrease scratching between the adjacent warp yarns 5*c* due to the opening movement. Such an effect is especially remarkably achieved when the warp yarn length D4 that is from a point where the warp yarn starts opening to the heald is 10 times or less of the shedding motion stroke amount of the heald. The same number of such easing mechanisms as the number of the healds is provided, and it is more preferable to change the easing mechanism for each heald that is threaded. Further, such an easing mechanism may be in a passive method in which the easing rolls 11*a* and 11*b* are moved by the fluctuation of the tension of the warp yarn by a spring or the like. However, it is preferably in a active method in which they are moved forcibly by the loom driving force, a separate motor, or the like. The active method can contribute to a reduction in fuzz even at a higher speed.

In one embodiment of the present invention, the reed width of the air jet loom is preferably 100 to 350 cm. It is more preferably in a range of 130 to 310 cm, and further preferably in a range of 150 to 260 cm. When a general shuttle loom, a general rapier loom or the like is used, there is a restriction in the width of the loom, that is, the reed width of the loom because there is a necessity that the shuttle or the rapier which is a weft yarn insertion means directly inserts the weft yarn. On the other hand, in the air jet loom, because the weft yarn is inserted by air, the reed width can be easily widen only by adding the sub-nozzle in the width direction. That is, in order to maximally achieve the effect of using the air jet loom, weaving is preferably performed in a wide width as in the above-described range.

Next, a further preferable embodiment is explained based on a schematic planar drawing showing one example of weaving by the air jet loom shown in FIG. 7.

In the case where the reed width of the air jet loom is a wide width as in the above-described range, carbon fiber woven fabrics 18*a*, 18*b*, and the like with a plurality of widths are preferably obtained by forming a selvedge structure 19*c* in the reed width but except at both end parts of the reed width. Generally, a piece of the carbon fiber woven fabric is obtained by forming the selvedge structure only at both end parts of the reed width. However, when two or more pieces of the carbon fiber woven fabrics 18*a*, 18*b*, and the like are obtained at the same time by forming selvedge structures 19*c*, and the like also in the reed width but at other than both end parts, the productivity can be improved even more. It is more preferably in a range of 2 to 12 pieces, and further preferably in a range of 3 to 7 pieces. When it exceeds 12 pieces, many apparatus for forming selvedge structures in the reed width (for example, a selvedge apparatus, a duplex heald, a "Crocker" heald, and the like) become necessary, and not only do they become an obstacle to obtaining a high speed, but also there is a case where the apparatus arrangement is restricted.

In weaving using the air jet loom, the carbon fiber woven fabric is woven by shedding motion of healds after the weft yarn insertion, and then a fringed selvege of the weft yarn can be tucked in the width of the woven fabric. By folding the fringed selvege into the width of the woven fabric by a tucking-in apparatus, a woven fabric can be obtained that does not have a fringed selvege like a fabric woven by the shuttle loom can be obtained. In the case where a uni-directional carbon fiber woven fabric having a selvege structure that is tucked in is used in repairing and reinforcing concrete, for example, and the uni-directional carbon fiber woven fabric is adhered by applying a resin onto the concrete piece, the applied resin amount can be minimized.

In one embodiment of the present invention, for the limitation of the above-described B (1), a uni-directional carbon fiber woven fabric having a carbon fiber strand with a fineness of 400 to 6,000 tex as the warp yarn and an auxiliary yarn as the weft yarn is woven. When the fineness of the carbon fiber strand used in the present invention is too small, the weaving density of the warp yarn becomes too high, a lot of fuzz of the carbon fiber strand is generated as described in the above-described A (3), and the quality of the carbon fiber woven fabric is degraded. On the other hand, when the fineness of the carbon fiber strand that is used is too large, the spacing between the warp yarns becomes too large, and the weft yarn insertion efficiency of the air jet loom decreases. Further, from a different viewpoint, when the fineness of the carbon fiber strand is in the above-described range, the carbon fiber strand can be obtained at a low price. Weaving using a carbon fiber strand in such a range by the air jet loom means further improvement in the productivity, and the effect of the present invention is exhibited largely.

The auxiliary yarn that is used in the present invention have a fineness of 1/5 or less of the fineness of the carbon fiber strand that is the weft yarn, preferably 1/20 to 1/500, and more preferably 1/100 to 1/250. When such the fineness is too large, a decrease in the mechanical properties due to crimping of the carbon fiber strand in the uni-directional woven fabric is induced. On the other hand, when such the fineness is too small, it means that the strength of the auxiliary fiber becomes too low, and there is a case where cutting of the weft yarn is often generated during weaving.

In the case of performing the weft yarn insertion by the air jet loom, when the carbon fiber strand is used as the weft yarn, there is a case where a problem is caused that fuzz of the carbon fiber strand is easily generated and the generated fuzz clogs loom parts such as a nozzle. When the woven fabric is a uni-directional woven fabric in which such an auxiliary fiber is used as the weft yarn, the above-described problem is not caused even when the weft yarn insertion is performed by the air jet loom, and the productivity of the carbon fiber woven fabric is not deteriorated.

Examples of such an auxiliary fiber that can be used include inorganic fibers (excluding a carbon fiber) such as a glass fiber and a metal fiber and organic fibers such as an aramid fiber, a PBO fiber, a nylon fiber, a polyester fiber, a polyvinyl alcohol fiber, a polyethylene fiber, a polypropylene fiber, a polyphenylenesulfide fiber, and a cotton fiber. Among these, inorganic fibers other than a carbon fiber having a small shrinkage rate during heating and that can minimize the shrinkage in the width direction of the carbon fiber woven fabric are especially preferable, and a glass fiber is especially preferable as a fiber that minimizes the generation of fuzz.

Further, a spun yarn, a twist yarn, an interlace textured yarn, and a covering yarn (a composite yarn in which a sheath yarn is wound around a core yarn) are preferable as the auxiliary fiber from the viewpoint of running properties of the weft yarn by the air ejection. As specific examples, a spun yarn of a glass fiber and/or an organic fiber and an interlace textured yarn (preferably, a Taslan processed yarn) of a glass fiber and/or an organic fiber are preferable. When such an auxiliary fiber is used, the running properties by the air jet can be stabilized remarkably compared with a simple filament yarn. Further, a frictional coefficient with the carbon fiber strand after weaving can be made large, and the waviness of the weft yarn, that is a problem in the present invention, can be minimized. As another specific example, a covering yarn in which a glass fiber as a core yarn is covered with a filament yarn of an organic fiber is also preferable. In the covering yarn, even if both of the glass fiber and the organic fiber are the filament yarns, yarn breaking of the weft yarn, fuzz of the weft yarn, and the like can be suppressed by the covering process, and the running properties by the air jet can be stabilized. Examples of the preferred organic fiber used here include a low melting point polymer fiber (a fiber made from copolymerized polyamide, copolymerized polyester, polyolefin, copolymerized polyolefin, or the like). When such a low melting point polymer fiber is used, intersection of the weaving yarn can be welded by adhering the carbon fiber strand and the auxiliary fiber by heating the carbon fiber strand, and it becomes easy to maintain the state of the obtained carbon fiber woven fabric, in which the weft yarn is straightly aligned without waviness, and that is excellent in quality.

From a different viewpoint, in one embodiment of the present invention, a carbon fiber strand is preferably used in which the tensile strength measured according to JIS-R7601 (1986) "Carbon Fiber Test Method" is 4000 MPa or more, and preferably 5000 MPa or more, against the above-described limitation of C (1). When the tensile strength is in such a range, a carbon fiber woven fabric can be produced in which it is difficult for fuzz to be generated and that is excellent in quality. Moreover, there is no upper limit in the tensile strength, and the higher the better. However, in the range of the technique that can be considered at present, 7000 MPa is considered to be the upper limit.

Meanwhile, because the weft yarn is directly pulled and inserted in the shuttle loom or the rapier loom that has been conventionally used for the production of the carbon fiber woven fabric, tension can be given to the weft yarn itself, and the problem that relates to the waviness of the weft yarn, that is a problem according to one aspect in the present invention, is relatively less exhibited. However, such a problem becomes obvious in the air jet loom in which the tension can not be given directly to the weft yarn in the insertion of the weft yarn. However, in the present invention, such a problem is preferably solved by giving the tension to the weft yarn before weaving and/or after weaving. The reason is explained in detail by referring to FIG. 7 in the following.

First, a different weaving structure 19*b* is woven at the same time with the weft yarn 14 that is the same as the weft yarn constituting the carbon fiber woven fabric, at least in the end part of the opposite-to-weft-yarn-insertion side B of the carbon fiber woven fabric to be woven. At this time, the carbon fiber woven fabric and the different weaving structure 19 that are woven are continuously fed to the downstream side. However, in the downstream side, a twist is given to the different weaving structure by cutting the weft yarn between the different weaving structure 19*b* and the carbon fiber woven fabric 18*b* to separate the different weaving structure and the carbon fiber woven fabric during the feeding. Of course, the same as the opposite-to-weft-yarn-insertion side B, the different weaving structure 19*b* may be woven at the same time with the weft yarn 14 that is same as that of the carbon fiber woven fabric in the end part of the weft yarn insertion side A, and the different weaving structures are woven in the reed width but other than at both end parts of the reed width, and a twist may be given to these different weaving structures. By twisting such different weaving structures 19*a*, 19*b*, and the like, tension can be added to the weft yarn 14 that is woven in the carbon fiber woven fabrics 18*a*, 18*b*, 18*c*, and the like, and a carbon fiber woven fabric can be easily obtained in which the weft yarns are straightly aligned without waviness, and that is excellent in quality.

Examples of the method of giving a twist to the different weaving structure include a method of using a guide having a hole and passing the different weaving structure through the hole and rotating the guide, and a method of sandwiching each of the top and bottom surfaces of the different weaving structure by an endless belt and rotating the belt. Among these, the former is preferable because the apparatus is simple and it is easily installed on the air jet loom.

Furthermore, in order to exert the tension to the weft yarn 14, the different weaving structure is preferably guided so that a distance between the different weaving structures 19*a* and

19*b* and the carbon fiber woven fabrics 18*a* and 18*b* becomes large while or after weaving the different weaving structures. Examples of the method of guiding the different weaving structure in such a way include a method of making the twist given in the downstream side large and a method of guiding the different weaving structure to a direction of which the different weaving structure is evacuated from the carbon fiber woven fabrics 18*a* and 18*b* by holding the different weaving structure that is separated in the downstream side. In order to exhibit the effect more efficiently, it is preferable to employ the method of making a twist that is given in the downstream side large so that the distance between the different weaving structure and the carbon fiber woven fabric becomes large before the weft yarn is cut between the different weaving structures 19*a* and 19*b* and the carbon fiber woven fabrics 18*a* and 18*b*.

Further, in such an embodiment, the uni-directional carbon fiber woven fabrics 18*a*, 18*b*, 18*c*, and the like preferably have a plane weaving, a twill weaving, or a satin weaving structure; the different weaving structures 19*a*, 19*b*, and the like preferably have a plane weaving, a leno weaving, or a combined structure of these. Especially, in order to give tension to the weft yarn as described above, more or stronger crossings of the warp yarn 17 and the weft yarn 14 of the different weaving structure are preferable. Therefore, the different weaving structure is especially preferably a leno weaving structure. The warp yarn 5 of the woven fabrics 18*a*, 18*b*, and 18*c* is a carbon fiber strand with the fineness of 400 to 6000 tex. However, the warp yarn 17 of the different weaving structures 19*a*, 19*b*, and the like is not necessarily an expensive carbon fiber strand; the same yarn as the auxiliary fiber used in the weft yarn is preferably used. In the case of using the above-described fiber that is explained as the auxiliary fiber as the weft yarn 17 of the different weaving structure instead of the carbon fiber strand, a glass fiber is preferably used as the warp yarn 17 that is the same as the weft yarn from the viewpoint that a shrinkage rate during heating is small and that can keep the shrinkage of the carbon fiber woven fabric to a minimum. However, an aramid fiber that is an organic fiber is preferably used as such a warp yarn 17 from the viewpoint of minimizing the yarn cutting.

In order to give tension to the weft yarn before weaving and/or after weaving, it is also preferable that the tubular bodies 15*a* and 15*b* whose both ends are opened are arranged in the opposite-to-weft-yarn-insertion side of the carbon fiber woven fabric to be woven, and the weft yarn 14 that is inserted to weave the carbon fiber woven fabric is passed from one opening port (an entrance) to the other opening port (an exit) of the tubular bodies 15*a* and 15*b* as described above by referring to FIGS. 1 and 2.

Specifically, in the embodiment shown in FIG. 1, the curved tubular body 15*a* is arranged on the back side (the side where the weft yarn is not inserted) of the reed 7, and the weft yarn 14 passes through the inside of the tubular body 15*a* by blowing air that blows from the front side toward the back side of the reed on the weft yarn 14 that ran to the end part of the reed width, using a stretch nozzle 16 or the like. Further, in FIG. 2, a straight tubular body 15*b* is arranged so as to intersect with the running direction of the weft yarn (that is, it is not parallel to the running direction) and is arranged on the front side (the side where the weft yarn is inserted) of the reed; the weft yarn 14 passes through the inside of the tubular body 15*b* by blowing air that blows toward the exit of the tubular body on the weft yarn 14 that ran to the end part of the reed width, using a stretch nozzle (not shown in the drawing), or the like. For such a tubular body, the weft yarn can be passed through the inside of the tubular body more efficiently and certainly not only by blowing the air by the stretch nozzle or the like, but also by decreasing the pressure inside the tubular body.

In order to give tension to the weft yarn before weaving and/or after weaving, the weft yarn that is inserted may be directly held by a clamping means (not shown in the drawing) arranged in the opposite-to-weft-yarn-insertion side B. Such a clamping means preferably moves synchronizing with a signal from a detector that detects that the weft yarn is inserted. Further, a force to a direction of bringing back to the weft insertion side A may be given to the weft yarn that if inserted right before the opening movement of the heald. With such a mode also, the tension can be given to the weft yarn before weaving and/or after weaving. Examples of the method of giving a force on the weft yarn to the direction of bringing back include a method of moving the guide position where the weft yarn is being passed through to the direction in which the weft yarn is brought back in every beating and a method of installing a pulling apparatus (a dragging apparatus) that stores the weft yarn and then giving the tension all the time to the direction in which the weft yarn is brought back other than the time when the weft yarn is running. From the view point that the apparatus becomes simple, the former is preferable.

Further, in one embodiment of the present invention, a resin is preferably adhered to the carbon fiber woven fabric to be produced in a shape of a line or a dot. When the resin is adhered to the woven fabric, the shape of the carbon fiber woven fabric can be stabilized, and the handling property of the carbon fiber woven fabric can be improved.

The resin can be given to the carbon fiber woven fabric in an arbitrary form such as a fiber form, a particle form, or an emulsion form or a dispersion form in which the resin is dissolved or dispersed into water, and adhered. Among these, from the viewpoints that it can be adhered easily and of exhibiting the above-described functions, a resin in a solid fiber form and a solid particle form is preferably used, and it is preferably adhered to the woven fabric. In the case of such a fiber form, it may be paralleled with the carbon fiber strand and the auxiliary fiber, woven together, and then adhered, or it may be woven together with the carbon fiber strand and the auxiliary fiber using a composite yarn that is formed by a covering process, a doubling and twisting process, mixed spinning, or the like, and then adhered. Especially, in the case of improving handling of the woven fabric, it is effective to adhere it by the resin in the fiber form being parallelized and inserted as the weft yarn or by inserting the composite yarn in which the resin was made into the composite yarn with the carbon fiber or the auxiliary fiber by the covering process or a doubling and twisting process as the weft yarn. Further, in the case of using the resin in a particle form, the solid particulate resin may be applied onto the surface of the woven carbon fiber woven fabric and adhered, or a dispersion which is comprised by dispersing resin in liquid such as water may be applied and adhered.

The resin that is adhered to the carbon fiber woven fabric is not especially limited as long as it improves the handling property of the carbon fiber woven fabric and/or it improves mechanical properties of the composite materials in which the carbon fiber woven fabric is used, and a thermosetting resin and/or a thermoplastic resin are/is appropriately selected and used. From the viewpoint of only improving the handling property of the woven fabric, it is preferably at least one type selected from epoxy, unsaturated polyester, vinyl ester, phenoxy, polyamide, polyester, polyvinylformal, and polyolefin, and among these, epoxy and polyamide are especially preferable. A melting point $T_m$ (a glass transition point+

50° C. for a resin that does not have the melting point) of such a resin that is measured at a temperature rising speed of 20° C./min from the absolutely dry state by a DSC (a differential scanning calorimeter) is preferably 150° C. or lower. On the other hand, the melting point $T_m$ is preferably 50° C. or higher from the viewpoint of the handling property in the case of handling the carbon fiber woven fabric under a normal environment.

As a method of adhering such a resin, the carbon fiber woven fabric and a heat source may be contacted and heated or the attached resin may be adhered to the woven fabric by heating without bringing the carbon fiber woven fabric and a heat source into contact. In the case of producing the carbon fiber woven fabric at a high speed of 1 m/min or more for example, it is preferably heated by contacting the carbon fiber woven fabric and the heat source. It is more preferably heated by using a method of heating by contacting with the heat source and a method of heating without contacting concomitantly. In one embodiment of the present invention, because a carbon fiber that is excellent in heat conductivity is used, the resin can be adhered efficiently even at a high speed of 1 m/min or more for example by arranging a plurality of the heat sources continuously in the production step of the carbon fiber woven fabric. Examples of such a heat source include a heating roll and a hot plate in the case of contacting. Further, in the case of not contacting, the example includes radiated heat heaters using a far infrared ray or a near infrared ray.

Furthermore, in order to further increase the productivity, it is preferable to wind the woven carbon fiber woven fabric once in a prescribed length L1, and then re-wind by dividing the wound carbon fiber woven fabric into a product length L2 that is a half or less of the prescribed length L1. Because the carbon fiber woven fabric obtained in the present invention is mainly used as a reinforcing material of the CFRP, when it is packed in a box without winding, wrinkles and curving are generated, and there is a case where the carbon fiber strand is damaged or the alignment (straightness) of the carbon fiber strand is disturbed. Because of that, the form in which the carbon fiber woven fabric is wound is preferably employed as a product form.

On the other hand, if the winding is regarded as a precondition, there is a necessity that the loom needs to be stopped often when the winding length is short even when a higher production speed is achieved by the present invention, and it is difficult for the effect of the present invention to be exhibited efficiently. Therefore, the prescribed length L1 that is a length two times or more of the product length L2 is continuously woven, and it is preferably wound once around an intermediate core (for example, a paper tube, an iron tube, or the like) that is different from the product core. By doing so, the frequency of the stoppage of the loom can be minimized, and a higher production speed (rotation speed of the loom) can be achieved. The carbon fiber woven fabric of the prescribed length L1 that is wound once is preferably re-wound by dividing the fabric into the product length L2 that is a half or less of the prescribed length L1 in a different step.

The prescribed length L1 is more preferably 3 times or more of the product length L2, and further preferably 5 times or more. Further, from a different viewpoint, the prescribed length L1 is preferably 300 m or more, more preferably 500 m or more, and further preferably 700 m or more.

In one embodiment of the present invention, it is preferable to release and parallelize the carbon fiber strand that is the weft yarn from each bobbin, and to weave the strand by directly guiding it to the loom. When each bobbin is warped or partially warped (beamed) and then a sheet shaped warp yarn group is parallelized and guided to the loom, unevenness of the thickness of each carbon fiber strand can be easily generated, and there are many cases where a difference in the yarn length is generated between strands, particularly when using a carbon fiber strand having a large fineness of 400 to 6,000 tex. Being caused by this, there is a case where the slack carbon fiber strand flutter during weaving and disturb the alignment (straightness). Furthermore, unevenness is generated in the obtained woven fabric itself, and there is a case where the quality of the woven fabric deteriorates. The above-described problems are solved by parallelizing each carbon fiber strand from each bobbin, guiding directly to the loom, and weaving without performing warping or partial warping.

EXAMPLES

Examples and Comparative Examples of the present invention are explained in the following. Each property was evaluated as follows.

(Weavability)

It was judged based on whether a continuous operation of at least 300 m is possible or not.

A: Continuous operation of 300 m or more is possible.

B: Continuous operation of 300 m or more is impossible.

(Generation of Fuzz)

It was judged by visually observing the amount of fuzz that is generated in the weft yarn caught in the heald and the reed during weaving using the amount in Comparative Example 1 as a standard.

A: The amount is remarkably smaller than in Comparative Example 1.

B: The amount is smaller than in Comparative Example 1.

C: The amount is the same as in Comparative Example 1.

(Weft Yarn Running Property)

The amount of generation of fuzz during weaving in the weft yarn was visually observed using the amount in Comparative Example 1 as a standard.

A: The amount is remarkably smaller than in Comparative Example 1.

B: The amount is smaller than in Comparative Example 1.

C: The amount is the same amount as in Comparative Example 1.

(Handling Property of Woven Fabric)

The slippage and the property of getting loose when a woven fabric is cut out into a 15 cm square with a pair of scissors were confirmed visually.

A: The slippage and the loosening can be ignored as a product.

(Warp Yarn Length Difference and Fluctuation Coefficient of the Warp Yarn Length in the Woven Fabric)

It was measured according to the following procedure.

(a) 5,500 mm of a carbon fiber woven fabric is spread and kept still under no tension so that it does sago slack.

(b) One portion of the woven fabric is cut perpendicular to the longitudinal direction of the spread woven fabric as a measurement standard.

(c) 5,000 mm is measured for each warp yarn of both end parts in the direction of the woven fabric width from the measurement standard, and the standard is cut at a line connecting the measured positions. In the measurement of length, 5,000 mm of the woven fabric is measured with a long scale measure by spreading the woven fabric and placing still under no tension so that the woven fabric does not go slack.

(d) The warp yarn is pulled out every 5 strands one by one over the entire width of the woven fabric while taking the woven fabric apart.

(e) The warp yarn length that is pulled out is measured to the order of 0.1 mm. In the measurement of length, it is measured with a long scale measure while applying tension of the level of pulling with a hand so that the warp yarn does not wave.

(f) The difference between the maximum value and the minimum value of the measured warp yarn length is calculated. The calculated difference is divided by 5,000 mm and multiplied by 100, and this value is regarded as the difference in the warp yarn length (unit is %).

(g) A standard deviation and an average value of all of values of the measured warp yarn length are calculated. The calculated standard deviation is divided by the average value and multiplied by 100, and this value is regarded as a fluctuation coefficient (unit is %).

(Warp Yarn Clearance in the Woven Fabric)

It was measured according to the following procedure.

(h) A 15 cm length is cut out from the carbon fiber woven fabric.

(i) By observing the cut-out woven fabric with an optical microscope, the distance of the clearance between the warp yarns is measured to the order of 0.01 mm one by one over the entire width of the woven fabric, and an average value of these values is calculated.

(Resin Impregnation Property in the Woven Fabric)

A room-temperature curable epoxy resin (TS Resin (S) manufactured by Toray Industries, Inc.) was dripped on the top surface of a two-layered uni-directional woven fabric, and the impregnation property into the back side when impregnating by a hand lay-up method was confirmed visually.

A: The resin impregnated promptly.

B: The resin impregnated slower than A, but it impregnated within a time scope at a level that it can be used as a product.

(Unevenness of the Woven Fabric)

5 m of a uni-directional woven fabric was spread on a floor and the unevenness was confirmed visually. It was judged whether there is unevenness that cannot be ignored as a product (unevenness in which the difference in high and low portions is about 3 mm or more) or not.

A: There is no unevenness that cannot be ignored as a product.

B: There is unevenness that cannot be ignored as a product (unevenness in which the difference in high and low portions is about 3 mm or more).

(Waviness of the Weft Yarn in the Woven Fabric)

A: Straightness of Comparative Example 2, or straightness of the same level as in Comparative Example 2.

B: Straightness deteriorates a little compared to Comparative Example 2. However, the waviness is at a level that can be ignored as a product.

Example 1

A uni-directional woven fabric (a plane weaving structure, carbon fiber areal weight 200 g/m$^2$) having a warp yarn density of 2.5 strands/cm and a weft yarn density of 3 strands/cm was woven at a speed of 1.1 m/min by an air jet loom (ZA100 manufactured by Tsudakoma Corporation) using the following warp yarn and weft yarn.

Warp yarn: Carbon fiber strand with the fineness of 800 tex (tension strength 4900 MPa, number of twists 0 turn/m measured according to JIS-R 7601 (1986)

Weft yarn: Yarn in which a glass yarn (ECE225 1/0.1.0Z) is covered with a copolymerized nylon yarn (5.5 tex, melting point 110° C.) at 250 turns/m (fineness 28 tex)

The carbon fiber strand (warp yarn) was released from each bobbin, parallelized, and guided to the loom directly at the reed width of 127 cm without warping. The warp yarn length from a position where the warp yarn starts opening to the heald was set to 12 times shedding motion stroke amount of the heald. Further, as shown in FIG. 5, the opening of the warp yarn introduced into the heald was partially suppressed using a free rotation roll (surface was pear-skin-finished) as the pressing bar 8*a* (the opening amount of the warp yarn 5*c* that was suppressed by arranging the pressing bar 8*a* (a length in the vertical direction) was smaller by 5 cm at the position of the pressing bar 8*a* than the original yarn path 9*a* without the pressing bar 8*a*).

The insertion of the weft yarn was performed so that the number of beating becomes 340 times/min using one main nozzle (0.25 MPa) and 16 sub-nozzles (0.4 MPa). Here, the arrangement relationship of the sub-nozzles was 2 nozzles with an interval of 70 mm, 6 nozzles with an interval of 55 mm, 4 nozzles with an interval of 50 mm, and 4 nozzles with an interval of 45 mm one by one from the weft yarn insertion side, and the distance between the sub-nozzle in the far end part and the adjacent sub-nozzle in the opposite-to-weft-yarn-insertion side was set shorter than that in the weft yarn insertion side.

Further, the shedding motion stroke amount of the heald was 60 mm, the angle of repose of heald in a shedding motion was 0°, the beating stroke amount was 85 mm, and the dent thickness was 0.5 mm. The sub-nozzle and the dent were arranged so that their centers exist on the same straight line parallel to the longitudinal direction of the woven fabric. Further, the fluctuation of the warp yarn tension was absorbed using an active easing mechanism in which motor drives.

After weaving, the copolymerized nylon yarn that was used in the weft yarn was adhered to the carbon fiber strand by heating the woven fabric by directly contacting the woven fabric to 4 heating rollers that are a heat source.

In such weaving, the generation of fuzz by the heald and the reed was suppressed, and continuous operation of at least 300 m was possible. Further, there was a slight variation in an arriving timing of the weft yarn to the opposite-to-weft-yarn-insertion side. However, it was at a level that there is no problem in weaving running properties.

The woven carbon fiber woven fabric was wound once in a prescribed length of 300 m, and the wound carbon fiber woven fabric was re-wound after dividing into 50 m that is the product length. With this operation, a length of 300 m was able to be woven continuously, and the weaving at a high speed was able to be continued without making the loom stopping by every 50 m. That is, it was excellent in productivity.

The intersections of yarns in the uni-directional woven fabric obtained was welded with the copolymerized nylon yarn adhered in a line shape, and was excellent in handling property. Further, because the spacing between the warp yarns was 0.15 mm and there was sufficient spacing, it was excellent in the impregnation property when impregnated with the resin. Further, a difference in the warp yarn length in the uni-directional woven fabric was 0.06%, its fluctuation coefficient was 4%, and when 5 m of the uni-directional woven fabric was spread on a floor, unevenness at a level that becomes a problem as a product was not observed at all. The weft yarns were aligned slightly waviness and deteriorated a little compared with Comparative Example 2 using a rapier loom. However, it was not at a level that causes a problem as a product.

Example 2

A carbon fiber woven fabric was woven in the same way as in Example 1 except the following points were changed.

- A broad width machine (reed width 152 cm) was used as the air jet loom.
- 24 sub-nozzles were used, the arrangement relationship of the sub-nozzles was 2 nozzles with an interval of 70 mm, 10 nozzles with an interval of 55 mm, 10 nozzles with an interval of 50 mm, and 4 nozzles with an interval of 45 mm one by one from the weft yarn insertion side, and the distance between the sub-nozzle in the far end part and the adjacent sub-nozzle in the opposite-to-weft-yarn-insertion side was set shorter than that in the weft yarn insertion side.
- A glass bulky yarn (a Taslan processed yarn of ECE225 1/0 1.0Z) was used as a glass yarn of the weft yarn, and it was covered with a copolymerized nylon yarn the same as in Example 1.
- The warp yarn 5*c* was suppressed and guided to the loom so that the warp yarn 5*c* that is introduced into the heald was not partially opened using a free rotation roll (surface was pear-skin-finished) as the pressing bar 8*a* (so that the yarn path of the warp yarn 5*c* to a position of the pressing bar 8*b* is parallelized and the warp yarn length D4 from a position where the warp yarn starts opening (the pressing bar 8*b*) to the heald becomes 5 times the shedding motion stroke amount of the heald).
- Using a passive easing mechanism of a spring.
- Heating after the weaving without bringing the woven fabric into contact with two far infrared heaters in addition to the heating roller.

Also in such weaving, the generation of fuzz at the warp yarn heald and the dent was suppressed more than in Example 1, and continuous operation of at least 300 m was possible. Further, the arriving timing of the weft yarn to the opposite-to-weft-yarn-insertion side was more stable than in Example 1, and the running properties were stable.

The woven carbon fiber woven fabric was wound once in a prescribed length of 300 m, and the wound carbon fiber woven fabric was re-wound by dividing into 50 m that is the product length.

The intersections of yarns in the uni-directional woven fabric obtained was welded with the copolymerized nylon yarn adhered in a line shape, and was excellent in the handling property. Further, because the spacing between the warp yarns was 0.21 mm and there was sufficient spacing, it was excellent in the impregnation property when impregnated with the resin. Further, the difference in the warp yarn length in the uni-directional woven fabric was 0.07%, its fluctuation coefficient was 5%, and when 5 m of the uni-directional woven fabric was spread on a floor, unevenness at a level that becomes a problem as a product was not observed at all. The weft yarn was aligned slightly waviness in the same manner as in Example 1. However, it was not at a level that becomes a problem as a product.

Example 3

A carbon fiber woven fabric was woven in the same way as in Example 1 except the following points were changed.

- The warp yarn density of the carbon fiber woven fabric was set to 3.9 strands/cm, the weft yarn density was set to 5 strands/cm, and the carbon fiber areal weight was set to 315 g/m$^2$.
- A different weaving structure (a leno weaving structure) using the same weft yarn as in the carbon fiber woven fabric (a plane weaving structure) was woven at the same time at the end parts of the weft yarn insertion side and the opposite-to-weft-yarn-insertion side of the carbon fiber woven fabric to be woven; the different weaving structure and the carbon fiber woven fabric were separated by cutting the weft yarn between the different weaving structure and the carbon fiber woven fabric in the downstream side, and a twist was given to the different weaving structure by passing a part of the different weaving structure that was separated through a guide having a hole and rotating the guide (that is, the different weaving structure was guided so that the distance between the different weaving structure and the carbon fiber woven fabric became large while weaving the different weaving structure).
- A tubular body whose axis is curved is arranged on the opposite side from the weft yarn insertion side of the woven carbon fiber woven fabric, and the weft yarn inserted to weave the carbon fiber woven fabric was passed from one opening port to the other opening port of the tubular body by the air blown from the front side toward back side of the reed.
- A plurality of main nozzles were arranged (that is, the auxiliary main nozzle was arranged in the upstream side of the main nozzle 12).

In such weaving, the generation of fuzz at the warp yarn heald and the reed was suppressed in the same manner as in Example 1, and continuous operation of at least 300 m was possible. Further, the arriving timing of the weft yarn to the opposite-to-weft-yarn-insertion side was stable similarly to Example 2, and the running properties were stable.

The woven carbon fiber woven fabric was wound once in a prescribed length of 300 m, and the wound carbon fiber woven fabric was re-wound by dividing into 50 m that is the product length.

The intersection of yarns in the uni-directional woven fabric obtained was welded with the copolymerized nylon yarn adhered in a line shape, and was excellent in the handling property. The spacing between the warp yarns was 0.1 mm, and the impregnation property when impregnated with the resin was good because there was spacing although it was not as large as in Examples 1 and 2. Further, the difference in the warp yarn length in the uni-directional woven fabric was 0.05%, its fluctuation coefficient was 4%, and when 5 m of the uni-directional woven fabric was spread on a floor, unevenness at a level that becomes a problem as a product was not observed at all. The waviness of the weft yarn was suppressed more than in Examples 1 and 2, and it was aligned very straight at the same level as in Comparative Example 2 using a rapier loom.

Example 4

A carbon fiber woven fabric was woven in the same way as in Example 3 except the following points were changed.

- The weaving structure of the carbon fiber woven fabric was changed to a plane weaving and made to be a 2/2 twill structure, and the different weaving structure was changed to a leno weaving and made to be a plane weaving structure.

The different weaving structure was guided so that the distance between the different weaving structure and the carbon fiber woven fabric became large after the different weaving structure was woven.

The curved tubular body was replaced with a straight tubular body; the straight tubular body was arranged on the front side of the reed so that the axis crosses with the running direction of the weft yarn. Air toward the exit of the tubular body was blown onto the weft yarn that is inserted in order to weave the carbon fiber woven fabric, and the weft yarn was passed through into the tubular body.

The guide is arranged to make the weft yarn pass through to the weft yarn insertion side, a position of the guide was moved to the direction in which the weft yarn is pulled back in every beating, and a force was applied onto the inserted weft yarn to the direction of pulling back the weft yarn to the weft yarn insertion side.

A spun yarn of a glass fiber and a copolymerized nylon yarn (5.5 tex, melting point 110° C.) was used as the weft yarn in place of the covering yarn.

Also in such weaving, the generation of fuzz by the heald and the reed was suppressed similarly to Example 3, and continuous operation of at least 300 m was possible. Further, the arriving timing of the weft yarn to the opposite-to-weft-yarn-insertion side was stable similarly to Examples 2 and 3, and the running properties were stable.

The woven carbon fiber woven fabric was wound once in a prescribed length of 300 m, and the wound carbon fiber woven fabric was re-wound by dividing into 50 m that is the product length.

The intersection of the yarns in the uni-directional woven fabric obtained was welded with the copolymerized nylon yarn adhered in a line shape, and was excellent in handling property. Further, the difference in the warp yarn length in the uni-directional woven fabric was 0.07%, its fluctuation coefficient was 5%, and when 5 m of the uni-directional woven fabric was spread on a floor, unevenness at a level that becomes a problem as a product was not observed at all. The waviness of the weft yarn was suppressed similarly to Example 3, and it was aligned very straight.

Example 5

A carbon fiber woven fabric was woven in the same way as in Example 1 except the following points were changed.

A clamping means that moves by synchronizing with a signal from a detector that detects that the weft yarn is inserted was provided in place of the tubular body, the weft yarn that was inserted was held by the clamping means, and tension was given to the weft yarn.

Also in such weaving, the generation of fuzz by the heald and the reed was suppressed similarly to Example 1, and continuous operation of at least 300 m was possible. Further, the arriving timing of the weft yarn to the opposite-to-weft-yarn-insertion side was the same as in Example 1, and it was a level that there is no problem in weaving in terms of the running properties.

The woven carbon fiber woven fabric was wound once in a prescribed length of 300 m, and the wound carbon fiber woven fabric was re-wound by dividing into 50 m that is the product length.

The intersection of the yarns in the uni-directional woven fabric obtained was welded with the copolymerized nylon yarn adhered in a line shape, and was excellent in handling property. The spacing between the warp yarns was 0.1 mm, and the impregnation property when impregnated with the resin was good because there was spacing although it was not as large as in Examples 1 and 2. Further, the difference in the warp yarn length in the uni-directional woven fabric was 0.07%, its fluctuation coefficient was 5%, and when 5 m of the uni-directional woven fabric was spread on a floor, unevenness at a level that becomes a problem as a product was not observed at all. The waviness of the weft yarn was suppressed to the same level as in Examples 3 and 4, and the weft yarn was aligned very straight.

Example 6

A carbon fiber woven fabric was woven in the same way as in Example 1 except the following points were changed.

The opening of the warp yarn introduced into the heald was not partially suppressed by not using the pressing bar 8*a*.

Also in such weaving, there was a little more generation of fuzz by the heald and the reed compared with Example 1. However, it was not at a level that becomes a problem as a product, and continuous operation of at least 300 m was possible. Further, the arriving timing of the weft yarn to the opposite-to-weft-yarn-insertion side was the same as in Example 1, and it was at a level that there is no problem in weaving as the running properties.

The woven carbon fiber woven fabric was wound in a prescribed length of 300 m.

The obtained uni-directional woven fabric had almost the same quality as that in Example 1. Specifically, the intersection of the yarns was welded with the copolymerized nylon yarn adhered in a line shape, and was excellent in handling property. Further, the spacing between the warp yarns was 0.17 mm, and the impregnation property when impregnated with the resin was good because there was sufficient spacing. Further, the difference in the warp yarn length in the uni-directional woven fabric was 0.08%, its coefficient was 4%; and when 5 m of the uni-directional woven fabric was spread on a floor, unevenness at a level that becomes a problem as a product was not observed at all. The weft yarn was aligned with slight waviness and deteriorates a little compared with Comparative Example 2 using a rapier loom. However, it was not at a level that becomes a problem as a product.

Comparative Example 1

A bi-directional woven fabric (carbon fiber areal weight 200 g/m$^2$) having the warp yarn density and weft yarn density of 5 strands/cm was woven by a water jet loom using carbon fiber strands with the fineness of 200 tex ("Torayca" (registered trademark) T300B-3 K manufactured by Toray Industries, Inc., the tension strength 3540 MPa measured according to JIS-R7601 (1986), number of twists 0 turn/m) as the warp yarn and the weft yarn. The weaving was performed at a speed of 0.8 m/min (the weft yarn beating 400 times/min) using a passive easing mechanism with a condition that the opening amount of the heald is 80 mm, without using the pressing bar, and with the warp yarn length from the position where the warp yarn starts opening to the heald is 12 times the shedding motion stroke amount (80 mm). The carbon fiber strands were released from each bobbin and parallelized, the warp yarn beam was obtained by warping once, and the weaving was performed using this beam.

Successively to the weaving, moisture attached to the carbon fiber strand was dried by directly contacting the woven fabric with 4 rollers that are a heat source. This drying step is a step that is not necessary in the air jet loom and that is essential only in the water jet loom.

In such weaving, there was a very large amount of fuzz generated at the weft yarn beating part, the heald, and the reed, and continuous operation of 200 m or more was impossible without removing the fuzz while stopping the loom. Further, a difference in the yarn length was generated in the warp yarn, and unevenness was generated in the obtained woven fabric itself as well at a level that becomes a problem as a product. Further, the difference in the yarn length in the bi-directional woven fabric was 0.3%, and its fluctuation coefficient was 17%.

Comparative Example 2

A uni-directional woven fabric of the same warp yarn density and weft yarn density was woven by a rapier loom using the same warp yarn and weft yarn as in Example 1. The carbon fiber strands were released from each bobbin, parallelized, and guided to the loom at a reed width of 100 cm without warping. The weaving was performed with a condition that the shedding motion stroke amount of the heald was 85 mm, the angle of repose of the heald in the shedding motion was 150°, the beating stroke was 100 mm, and the dent thickness was 0.2 mm, without using an easing mechanism and the pressing bar, so that the warp yarn length from the position where the warp yarn starts opening to the heald becomes 12 times the shedding motion stroke amount (80 mm).

As a result, weaving in which fuzz was suppressed at the same level as in Example 1 was possible only at a speed of 0.6 m/min (the weft yarn beating 180 times/min). Further, the intersection of yarns in the uni-directional woven fabric obtained was welded with the copolymerized nylon yarn adhered in a line shape, and was excellent in handling property. The spacing between the warp yarns was 0.15 mm, and there was a sufficient spacing. However, the difference in the warp yarn length in the uni-directional woven fabric was 0.21%, and its fluctuation coefficient was 11%. Further, when 5 m of the uni-directional woven fabric was spread on a floor, unevenness in which the difference between high and low portions is 5 mm or more was scattered to some extent. The waviness of the weft yarn was suppressed, and the weft yarn was aligned very straight.

The above results are summarized in Table 1.

INDUSTRIAL APPLICABILITY

As explained above, in the method for producing the carbon fiber woven fabric of the present invention, it becomes possible to increase the productivity (production speed) of the woven fabric remarkably by using an air jet loom.

The obtained carbon fiber woven fabric becomes a woven fabric in which the weft yarns are straightly aligned without waviness, the difference in the warp yarn length and the fluctuation coefficient are in a specified range, and that is excellent in quality. Such a carbon fiber woven fabric is preferable as a woven fabric for a correction and a reinforcement use that is used in general industrial fields especially in civil engineering and the construction field, a woven fabric for forming into a CFRP by a vacuum forming method or the like, and a woven fabric for prepreg by a hot-melt method or the like.

The invention claimed is:

1. A method for producing a uni-directional carbon fiber woven fabric woven comprising:

weaving a carbon fiber strand having a fineness of 400 to 6,000 tex as a warp yarn and an auxiliary fiber having a fineness of ⅕ or less of the carbon fiber strand as a weft yarn to form the uni-directional carbon fiber woven fabric, wherein said weaving of the uni-directional carbon fiber woven fabric includes weaving by an air jet loom in which a heald in a shedding motion has an angle of repose in a range of 0 to 50°;

weaving a different weaving structure simultaneously at least in an end that is an opposite side from a weft yarn insertion side of the carbon fiber woven fabric using the weft yarn weaving the carbon fiber woven fabric; and giving a twist to the different weaving structure after cutting the weft yarn between the different weaving structure and the carbon fiber woven fabric to separate the different weaving structure from the carbon fiber woven fabric.

2. The production method according to claim 1, wherein the warp yarn density of the carbon fiber woven fabric is 1 to 8 strands/cm and the weft yarn density thereof is 0.4 to 8 strands/cm.

TABLE 1

| | Weaving Speed (Number of Weft Yarn Beating) | Weaving Property (Fuzz Generation) | Weft Yarn Running Property | Handling Property | Difference in Warp Yarn Length [%] | Fluctuation Coefficient of Warp Yarn Length [%] | Warp Yarn Spacing [mm] (Impregnation Properties) | Unevenness in Woven Fabric | Meandering of Weft Yarn |
|---|---|---|---|---|---|---|---|---|---|
| Example 1 | 1.1 m/min (340 times/min) | A (B) | B | A | 0.06 | 4 | 0.15 (A) | A | B |
| Example 2 | 1.1 m/min (340 times/min) | A (A) | A | A | 0.07 | 5 | 0.21 (A) | A | B |
| Example 3 | 1.1 m/min (340 times/min) | A (B) | A | A | 0.05 | 4 | 0.1 (B) | A | A |
| Example 4 | 1.1 m/min (340 times/min) | A (B) | A | A | 0.07 | 5 | — | A | A |
| Example 5 | 1.1 m/min (340 times/min) | A (B) | B | A | 0.07 | 5 | 0.1 (B) | A | A |
| Example 6 | 1.1 m/min (340 times/min) | A (B-C) | B | A | 0.08 | 4 | 0.17 (A) | A | B |
| Comparative Example 1 | 0.8 mm/min (400 times/min) | B (C) | C | — | 0.3 | 17 | — | B | — |
| Comparative Example 2 | 0.6 m/min (180 times/min) | A (B) | —(Rapier) | A | 0.21 | 11 | 0.15 (A) | B | A |

3. The production method according to claim 1, wherein the twist is given to the different weaving structure by passing the different weaving structure through a guide having a hole and rotating the guide.

4. The production method according to claim 1, further comprising leading the different weaving structure so that the distance between the different weaving structure and the carbon fiber woven fabric becomes broad while weaving or after weaving the different weaving structure.

5. The production method according to claim 1, wherein the carbon fiber woven fabric has a plain weaving structure, a twill weaving structure, or a satin weaving structure, and the different weaving structure has a plain weaving structure, a leno weaving structure, or a structure as a combination thereof.

6. The production method according to claim 1, further comprising arranging a tubular body in a side that is an opposite side from a weft yarn insertion side of the carbon fiber woven fabric so that the axis crosses with the running direction of the weft yarn, or arranging a tubular body whose axis is curved in a side that is the opposite side from the weft yarn insertion side of the carbon fiber woven fabric, and the weft yarn inserted to weave the carbon fiber woven fabric is passed through from one opening port to the other opening port of the tubular body.

7. The production method according to claim 1, wherein the air jet loom has one main nozzle and a plurality of sub-nozzles that eject air, each sub-nozzle is arranged at an interval of one per a woven fabric width of 2 to 15 cm in a downstream side of the main nozzle in a running direction of the weft yarn, the air jet loom has an auxiliary main nozzle that ejects air in the upstream side of the main nozzle in the running direction of the weft yarn, and the weft yarn is run by ejecting air from these nozzles.

8. The production method according to claim 1, wherein a shedding motion stroke amount of the heald in the air jet loom is in a range of 10 to 75 mm.

9. The production method according to claim 1, wherein the shedding motion of the warp yarn introduced into the heald is at least partially limited.

10. The production method according to claim 1, wherein the air jet loom has a plurality of sub-nozzles that eject air, and each sub-nozzle is arranged so that a center of the sub-nozzle and a center of a dent exist on substantially the same straight line parallel to the longitudinal direction of the woven fabric.

11. The production method according to claim 1, wherein a dent thickness of a reed in the air jet loom is in a range of 0.1 to 2 mm.

12. The production method according to claim 1, wherein a beating stroke amount in the air jet loom is in a range of 50 to 150 mm.

13. The production method according to claim 1, wherein the air jet loom has a plurality of sub-nozzles that eject air, a reed width is in a range of 100 to 350 cm, and a distance between the sub-nozzle in a far end part of a side that is the opposite side from the weft yarn insertion side and the sub-nozzle adjacent thereto is shorter than a distance between the sub-nozzle in the far end part of the weft yarn insertion side and the sub-nozzle adjacent thereto.

14. The production method according to claim 1, wherein a reed width in the air jet loom is in a range of 100 to 350 cm, and a selvedge structure is formed in the reed width but except at both ends of the reed width.

15. The production method according to claim 1, wherein the weft yarn is at least one type selected from a group consisting of a spun yarn of a glass fiber and an organic fiber, a spun yarn of a glass fiber, a spun yarn of an organic fiber, an interlace textured yarn of a glass fiber and an organic fiber, an interlace textured yarn of a glass fiber, and an interlace textured yarn of an organic fiber.

16. The production method according to claim 1, wherein the weft yarn is a covering yarn made by covering a filament yarn of an organic fiber with a glass fiber as a core yarn.

17. The production method according to claim 1, wherein the carbon fiber woven fabric is wound once in a prescribed length L1, and the wound carbon fiber woven fabric is rewound by dividing into a product length L2 that is a half or less of the prescribed length L1.

18. The production method according to claim 1, further comprising unwinding and parallelizing the carbon fiber strand that is the warp yarn from a bobbin, and the carbon fiber strand is directly led to the air jet loom.

* * * * *